US008641361B2

(12) United States Patent
June et al.

(10) Patent No.: US 8,641,361 B2
(45) Date of Patent: Feb. 4, 2014

(54) AIRFLOW FROM A BLOWER WITH ONE OR MORE ADJUSTABLE GUIDE VANES THAT ARE AFFIXED TO THE BLOWER AT ONE OR MORE PIVOT POINTS LOCATED IN AN OUTLET OF THE BLOWER

(75) Inventors: Michael S. June, Raleigh, NC (US); Jason A. Matteson, Raleigh, NC (US); Mark E. Steinke, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 828 days.

(21) Appl. No.: 12/756,594

(22) Filed: Apr. 8, 2010

(65) Prior Publication Data

US 2011/0250049 A1 Oct. 13, 2011

(51) Int. Cl.
*F04D 27/00* (2006.01)

(52) U.S. Cl.
USPC ..... 415/1; 415/16; 415/17; 415/20; 415/23; 415/33; 415/36; 415/48; 415/118; 415/129; 415/146; 415/150; 415/191; 415/195; 415/206; 415/212.1; 416/1; 416/61; 416/203

(58) Field of Classification Search
USPC ..... 415/1, 16, 17, 20, 23, 33, 47, 48, 36, 415/118, 129, 146, 150, 191, 195, 203–206, 415/208.1, 212.1; 416/1, 61, 203
See application file for complete search history.

(56) References Cited

U.S. PATENT DOCUMENTS 2,705,537 A * 4/1955 Nichols ..... 416/61
2,989,855 A 6/1961 Thompson
3,588,270 A 6/1971 Boelcs
4,385,552 A 5/1983 Nabben
4,578,605 A 3/1986 Reinhardt et al.
4,872,213 A 10/1989 Sebald et al.
4,877,370 A 10/1989 Nakagawa et al.
5,063,833 A 11/1991 Hara et al.
5,165,849 A 11/1992 Nakagawa et al.
5,281,094 A * 1/1994 McCarty et al. ..... 416/147
5,588,910 A 12/1996 Hutter et al.
5,618,160 A 4/1997 Harada et al.
5,683,223 A 11/1997 Harada et al.
5,850,873 A 12/1998 Liu
5,865,618 A 2/1999 Hiebert
5,873,696 A 2/1999 Harada et al.
6,158,954 A 12/2000 Nabeshima et al.
6,454,247 B2 9/2002 Ujvari
6,772,599 B2 8/2004 Bodell et al.

(Continued)

OTHER PUBLICATIONS

T. D. Boucher et al., "Viability of dynamic cooling control in a data center environment," ITHERM, Jun. 1-4, 2004, vol. 1, pp. 593-600.

(Continued)

*Primary Examiner* — Igor Kershteyn

(74) *Attorney, Agent, or Firm* — H. Barrett Spraggins; Thomas E. Tyson; Biggers Kennedy Lenart Spraggins LLP

(57) ABSTRACT

Methods, apparatus, and products are disclosed for improving the airflow exiting a blower that has one or more adjustable guide vanes that are affixed to the blower at one or more pivot points located in an outlet of the blower that include: determining a rotational speed of an impeller in the blower and adjusting a position of at least one of the adjustable guide vanes in dependence upon the rotational speed of the impeller.

25 Claims, 13 Drawing Sheets

(56) References Cited

U.S. PATENT DOCUMENTS

| | | | |
|---|---|---|---|
| 6,997,799 | B2 | 2/2006 | Mrozek et al. |
| 7,097,411 | B2 | 8/2006 | Smoke et al. |
| 7,326,027 | B1 | 2/2008 | Skoch et al. |
| 7,416,481 | B2 | 8/2008 | Baker et al. |
| 2009/0016019 | A1 | 1/2009 | Bandholz et al. |
| 2011/0250047 | A1 | 10/2011 | June et al. |
| 2011/0250048 | A1 | 10/2011 | June et al. |

OTHER PUBLICATIONS

Office Action, U.S. Appl. No. 12/756,429, Apr. 5, 2013, 1-09.
Notice of Allowance, U.S. Appl. No. 12/756,429, Jul. 24, 2013, 1-06.
Office Action, U.S. Appl. No. 12/756,472, Feb. 6, 2013, 1-10.
Final Office Action, U.S. Appl. No. 12/756,472, Jul. 11, 2013, 1-06.
Notice of Allowance, U.S. Appl. No. 12/756,472, Oct. 8, 2013, 1-07.

* cited by examiner

AIRFLOW FROM A BLOWER WITH ONE OR MORE ADJUSTABLE GUIDE VANES THAT ARE AFFIXED TO THE BLOWER AT ONE OR MORE PIVOT POINTS LOCATED IN AN OUTLET OF THE BLOWER

BACKGROUND OF THE INVENTION

1. Field of the Invention

The field of the invention is improving airflow from a blower, or, more specifically, methods, apparatus, and products for improving airflow from a blower with one or more adjustable guide vanes that are affixed to the blower at one or more pivot points located in an outlet of the blower.

2. Description of Related Art

The development of the EDVAC computer system of 1948 is often cited as the beginning of the computer era. Since that time, computer systems have evolved into extremely complicated devices. Today's computers are much more sophisticated than early systems such as the EDVAC. Computer systems typically include a combination of hardware and software components, application programs, operating systems, processors, buses, memory, input/output devices, and so on. As advances in semiconductor processing and computer architecture push the performance of the computer higher and higher, more sophisticated computer software has evolved to take advantage of the higher performance of the hardware, resulting in computer systems today that are much more powerful than just a few years ago.

Many of the hardware components that form today's complex computing systems tend to generate heat. Operating such hardware components above certain temperatures can result in decreased performance by the hardware components, total failure of the hardware components, and even irreparable damage to the hardware components. One way to counteract the heat generating nature of the hardware components is through the use of blowers that deliver cool air to hardware components. Such blowers, however, often deliver cool air through an outlet of the blower in a manner that is not uniform. Typically, the outlet velocity profile is preferenced to one side of the outlet area. As such, airflow distribution to heat sinks and other hardware components may not be ideal, especially when the heat sinks and other hardware components are placed close to the blower outlet because there is not enough flow development length available to allow for the proper flow distribution. As a result, the efficiency of the heat sinks and other hardware components is reduced and hence, the thermal performance is reduced. In addition, when the blower fails, it also tends to be a source of flow re-circulation. This back flow reduces the total airflow moving through the system.

SUMMARY OF THE INVENTION

Methods, apparatus, and products are disclosed for improving airflow from a blower with one or more adjustable guide vanes that are affixed to the blower at one or more pivot points located in an outlet of the blower that include determining a rotational speed of an impeller in the blower and adjusting a position of at least one of the adjustable guide vanes in dependence upon the rotational speed of the impeller.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
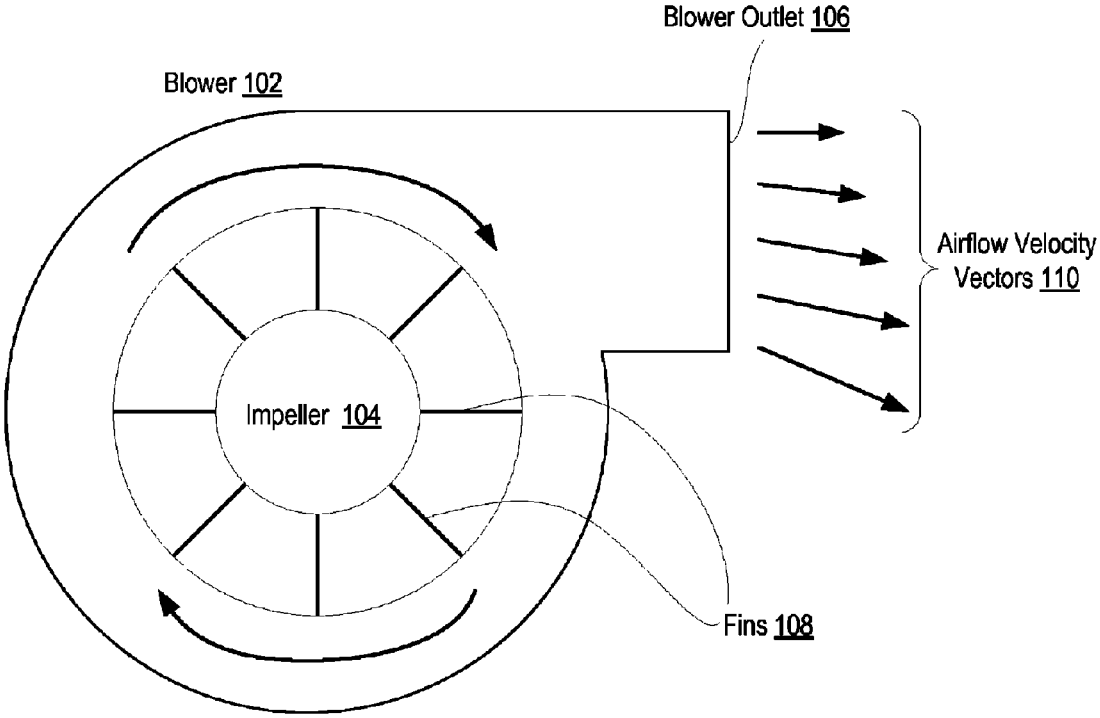
PRIOR ART FIG. 1
FIG. 1 sets forth a diagram of a prior art blower.

Exemplary methods, apparatus, and products for improving airflow from a blower with one or more adjustable guide vanes that are affixed to the blower at one or more pivot points located in an outlet of the blower in accordance with the present invention are described with reference to the accompanying drawings, beginning with FIG. 1. FIG. 1 sets forth a diagram of a prior art blower (102). The blower (102) includes a blower outlet (106) and an impeller (104) that includes fins (108). In the example of FIG. 1, the impeller (104) is configured to rotate about a rotational center. When the impeller (104) is rotated the fins (108) cause air to be moved such that airflow exits the blower (102) via the blower outlet (106). As shown by the airflow velocity vectors (110) in the example of FIG. 1, airflow exiting the blower (102) is non-uniform in the sense that airflow does not exit the blower (102) at the same velocity or angle across the entire face of the blower outlet (106).

Figure 2:
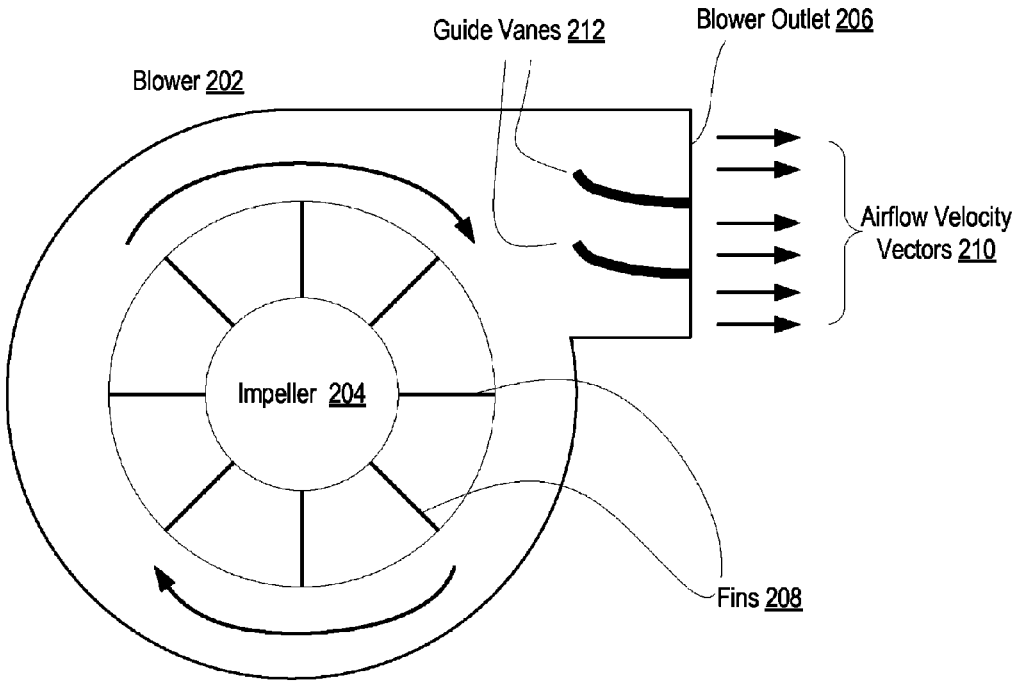
PRIOR ART FIG. 2
FIG. 2 sets forth a diagram of a prior art blower.

FIG. 2 sets forth a diagram of an additional prior art blower (202). The blower (202) includes a blower outlet (206) and an impeller (204) that includes fins (208). In the example of FIG. 2, the impeller (204) is configured to rotate about a rotational center. When the impeller (204) is rotated the fins (208) cause air to be moved such that airflow exits the blower (202) via the blower outlet (206). In the example of FIG. 2, the blower (202) also includes guide vanes (212). The guide vanes (212) of FIG. 2 serve as physical obstacles that alter the flow of air through the guide vanes (212). In the example of FIG. 2, the guide vanes (212) may be shaped and positioned such that airflow exiting the blower (202) is more uniform in the sense that airflow exits the blower (202) at a more consistent velocity and angle across the entire face of the blower outlet (206) as shown by the airflow velocity vectors (210).

Figure 3:
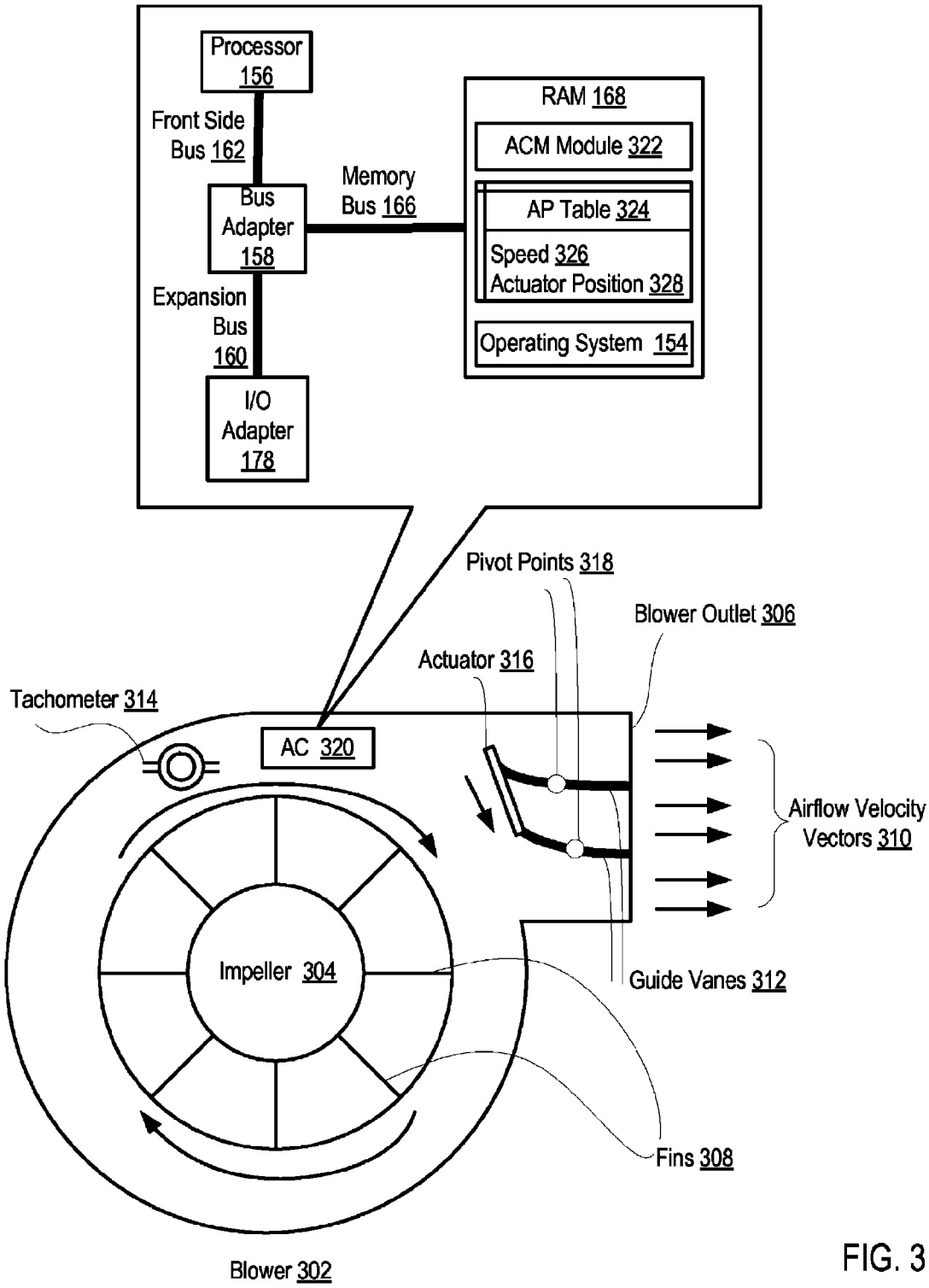
FIG. 3 sets forth a diagram of an exemplary blower with adjustable guide vanes that are affixed to the blower at pivot points located in an outlet of the blower.

FIG. 3 sets forth a diagram of a blower (302) with adjustable guide vanes (312) that are affixed to the blower (302) at pivot points (318) located in an outlet (306) of the blower (302). The blower (302) of FIG. 3 includes an impeller (304) configured to rotate around a rotational center. When the impeller (304) is rotated the fins (308) cause air to be moved such that airflow exits the blower (302) via the blower outlet (306) as illustrated by the airflow velocity vectors (310). The blower (302) of FIG. 3 also includes a driving mechanism configured to adjust a position of the one or more adjustable guide vanes (312) in dependence upon a rotational speed of the impeller (304). In the example of FIG. 3, the rotational speed of the impeller is measured by a tachometer (314). A tachometer is an instrument configured to measure the rotational speed of a shaft or disk. In the example of FIG. 3, the tachometer (314) may be configured to measure the rotational speed of the impeller (304), for example, by measuring the rotational speed of a shaft (not shown) that the impeller (304) rotates around. The rotational speed can be expressed, for example, as a number of revolutions per unit of time.

In the example of FIG. 3, the driving mechanism configured to adjust a position of the one or more adjustable guide vanes (312) is an actuator (316) that is connected to the one or more adjustable guide vanes (312). An actuator is a mechanical device for moving a mechanism or system. In the example of FIG. 3, the actuator (316) is configured to move the guide vanes (312) around one or more pivot points (318). The actuator (316) of FIG. 3 may move the guide vanes (312) around the one or more pivot points (318) by exerting a force on the guide vanes (312) thereby causing the guide vanes (312) to rotate around the one or more pivot points (318). Because the guide vanes (312) of FIG. 3 are connected to the actuator (316), moving the actuator (316) will result in movement of the guide vanes (312) around the one or more pivot points (318) such that the positioning of the guide vanes (312) can be adjusted by moving the actuator (316). The actuator (316) of FIG. 3 may be located in the interior of the blower (302) or located on the exterior of the blower (302) such that the actuator (316) does not impact airflow through the blower (302). In the example of FIG. 3, the actuator (316) is embodied as a linear actuator. A linear actuator is an actuator that applies force in a linear manner to achieve linear motion. In the example of Figure, the actuator (316) may achieve linear motion that is, for example, perpendicular to the guide vanes (312) such that the guide vanes (312) rotate about the pivot points (318).

The actuator (316) in the example of FIG. 3 is controlled by an actuator controller (320). The actuator controller (320) of FIG. 3 can be embodied as a module of automated computing machinery configured to control the operation of the actuator (316). The actuator controller (320) of FIG. 3 includes one or more input/output ('I/O') adapters (178). I/O adapters implement input/output through, for example, software drivers and computer hardware. In the example of FIG. 3, the I/O adapter (178) may be a special purpose adapter for controlling output to the actuator (316) and for receiving input from the tachometer (314). The I/O adapter (178) of FIG. 3 can be configured to receive input from the tachometer (314), for example, through the use of DB9 connectors or another I/O interface capable of exchanging data between the tachometer (314) and the actuator controller (320). The actuator controller (320) may be embodied, for example, as a field programmable gate array (FPGA), application-specific integrated circuit (ASIC), complex programmable logic device (CPLD), or other special purpose module of automated computing machinery.

The actuator controller (320) of FIG. 3 also includes at least one computer processor (156) or 'CPU' as well as random access memory (168) ('RAM') which is connected through a high speed memory bus (166) and bus adapter (158) to processor (156) and to other components of the actuator controller (320). Stored in RAM (168) is an actuator control module (322), a module of computer program instructions for controlling the operation of an actuator such as the actuator (316) of FIG. 3. Also stored in RAM (168) is an operating system (154). Operating systems useful improving airflow from a blower with one or more adjustable guide vanes that are affixed to the blower at one or more pivot points located in an outlet of the blower according to embodiments of the present invention include UNIX™, Linux™, Microsoft XP™, AIX™, IBM's i5/OS™, and others as will occur to those of skill in the art. The operating system (154) and actuator control module (322) in the example of FIG. 3 are shown in RAM (168), but many components of such software typically are stored in any form of computer memory.

The actuator control module (322) of FIG. 3 includes computer program instructions that, when executed, cause the actuator control module (322) to receive a measure of rotational speed of the impeller (304). Receiving a measure of rotational speed of the impeller (304) may be carried out, for example, through the use of the tachometer (314) that is coupled to actuator controller (320) via the I/O adapter (178). The measure of rotational speed may be specified, for example, as a number of times that the impeller (304) is rotated in a particular unit of time. The actuator control module (322) of FIG. 3 also includes computer program instructions that, when executed, cause the actuator control module (322) to adjust the position of the actuator in dependence upon the rotational speed of the impeller. Adjusting the position of the actuator in dependence upon the rotational speed of the impeller may be carried out, for example, by powering up an electronic motor (not shown) that drives the actuator (316) such that the actuator (316) is displaced, thereby adjusting the position of the guide vanes (312).

Adjusting the position of the actuator may include accessing an actuator positioning table to identify the optimal position of the actuator (316) for various impeller (304) speeds. In the example of FIG. 3, the actuator control module (322) may accesses an actuator positioning table (324) that associates rotational speeds (326) with predetermined optimal positions (328) for the actuator (316). The predetermined optimal positions (328) for the actuator (316) may be expressed, for example, as a percentage of full extension for a linear actuator. Table 1 illustrates an example of an actuator positioning table (324):

TABLE 1

| Actuator Positioning Table | |
|---|---|
| Impeller Speed (Rotations/Sec) | Actuator Position (% of full extension) |
| 0 | 0 |
| 1 | 25 |
| 2 | 50 |
| 3 | 75 |
| 4+ | 100 |

In the example of Table 1, higher impeller speeds are associated with increased actuator extension. For example, when an impeller is rotating at a rate of 1 rotation per second, the actuator should be extended to 25% of full extension. In this example, if the impeller speed is increased to 3 rotations per second, the actuator should be extended to 75% of full extension.

The percentage that an actuator is extended may be determined, for example, based on the amount of time that an electronic motor that drives the actuator (316) must be powered on to fully extend the actuator (316). For example, if an electronic motor must be powered on for 2 seconds to fully extend the actuator (316), running the electronic motor for 0.5 seconds would result in extending the actuator (316) to 25% of full extension, while running the electronic motor for a full second would result in extending the actuator (316) to 50% of full extension, and so on. In the example of FIG. 3, the actuator positioning table (324) is stored in RAM (168) of the actuator controller (320). Actuator positioning tables (324) according to embodiments of the present invention may be stored in any form of computer memory as will occur to those of skill in the art.

In the example of FIG. 3, the pivot points (318) for each of the one or more guide vanes (312) are adjustable. The pivot points (318) are adjustable in the sense that the pivot points (318) themselves may actually be repositioned. For example, the pivot points (318) may be mounted to the blower (302) in a groove such that the pivot points (318) may slide within the groove. Adjusting the pivot points (318) may therefore be carried out by sliding the pivot points (318) within the groove such that the location of the pivot points (318) is altered. The pivot points (318) may be adjusted, for example, through the use of automated machinery that is controlled by the actuator controller (320). The pivot points (318) may alternatively be adjusted in a purely mechanical implementation in which, for example, force imparted by the airflow generated by the impeller (304) causes the pivot points (318) to slide within a groove that the pivot points (318) are mounted within.

Figure 4:
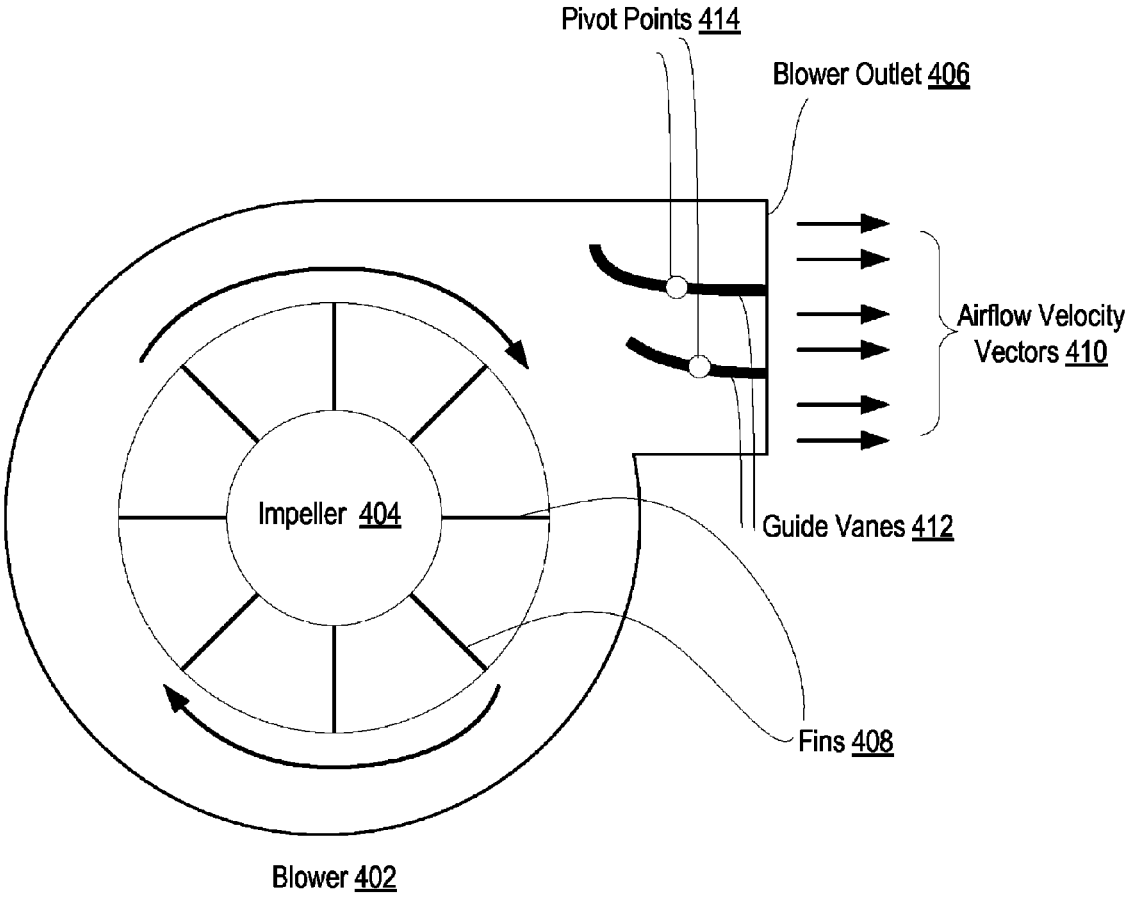
FIG. 4 sets forth a diagram of a further exemplary blower with adjustable guide vanes that are affixed to the blower at pivot points located in an outlet of the blower.

For further illustration, FIG. 4 sets forth a diagram of a blower (402) with adjustable guide vanes (412) that are affixed to the blower (402) at pivot points (414) located in an outlet (406) of the blower (402). The blower (402) of FIG. 4 includes an impeller (404) configured to rotate around a rotational center. When the impeller (404) is rotated the fins (408) cause air to be moved such that airflow exits the blower (402) via the blower outlet (406). The airflow that exits the blower (402) via the blower outlet (406) is illustrated by the airflow vectors (410) of FIG. 4.

The blower (402) includes one or more guide vanes (412). Each of the one or more guide vanes (412) is affixed to the blower (402) at a pivot point (414). In the example of FIG. 4, at least two of the guide vanes (412) have different physical attributes. For example, the guide vanes (412) of the blower (402) of FIG. 4 may be of different lengths, different weights, different densities, or may be constructed such that the flexural strength of the guide vanes (412) are different. In the example of FIG. 4, the physical attributes of the one or more guide vanes (412) are predetermined such that an airflow exit speed at each of one or more exit points in the blower outlet (406) is consistent within a predetermined range, as shown by the airflow velocity vectors (410).

In the example of FIG. 4, each of the guide vanes (412) may pivot about a pivot point (414). As such, the force exerted on the guide vanes (412) by airflow generated by the impeller (404) causes each guide vane (412) to pivot about a pivot point (414). By determining the amount of airflow that will be generated by the impeller (404), the physical attributes of the guide vanes (412) can be configured such that the force exerted on the guide vanes (412) by airflow generated by the impeller (404) causes the guide vanes (412) to pivot about a pivot point (414) in a way that causes a more uniform distribution of airflow via the blower outlet (406).

The guide vanes (412) of FIG. 4 may be designed such that when the impeller (404) is not rotating, the weight, length, and other physical attributes of the guide vanes (412) causes the guide vanes to pivot about the pivot points (414) such that the guide vanes (412) are in a 'closed' position, meaning that airflow does not enter or exit the blower through the blower outlet (406). Once the impeller (404) begins rotating, airflow is generated from the impeller (404). This airflow generated by the impeller (404) exerts a force of the guide vanes (412) that causes the guide vanes (412) to pivot about the pivot points (414). If, for example, the impeller (404) is always rotated at a constant speed when powered on, the amount of airflow generated by the impeller (404) can be measured and the amount of force that such airflow exerts on the guide vanes (412) can also be determined. Because the amount of force exerted on the guide vanes (412) is known, the physical attributes of the guide vanes (412) can be configured such that the force exerted on the guide vanes (412) causes the guide vanes (412) to pivot, or adjust, into a position that creates a more uniform distribution of airflow exiting the blower outlet (406).

In the example of FIG. 4, at least two of the guide vanes (412) are weighted differently. The weight of each guide vane (412) impacts the degree to which a particular guide vane (412) will pivot about a pivot point (414). That is, with all other factors being equal, a heavier guide vane will pivot less about a pivot point than a lighter guide vane as the result of a force being exerted on the guide vanes (412) by airflow from the impeller (404). As such, the force being exerted on the guide vanes (412) by airflow from the impeller (404) will cause a heavier guide vane to be positioned differently than a lighter guide vane, thereby altering the distribution of airflow exiting the blower outlet (406). By taking the weight of each guide vane (412) into account, the remaining physical attributes of the guide vanes (412) can be more precisely configured such that the force exerted on the guide vanes (412) causes the guide vanes (412) to pivot, or adjust, into a position that creates a more uniform distribution of airflow exiting the blower outlet (406).

In the example of FIG. 4, at least two of the guide vanes (412) are of different lengths. The length of the guide vanes (412) impacts the degree to which a particular guide vane (412) will pivot about a pivot point (414). That is, with all other factors being equal, a shorter guide vane will pivot less about a pivot point than a longer guide vane as the result of a force being exerted on the guide vanes (412) by airflow from the impeller (404). As such, the force being exerted on the guide vanes (412) by airflow from the impeller (404) will cause a shorter guide vane will be positioned differently than a longer guide vane, thereby altering the distribution of airflow exiting the blower outlet (406). By taking the length of each guide vane (412) into account, the remaining physical attributes of the guide vanes (412) can be more precisely configured such that the force exerted on the guide vanes (412) causes the guide vanes (412) to pivot, or adjust, into a position that creates a more uniform distribution of airflow exiting the blower outlet (406).

In the example of FIG. 4, at least two of the guide vanes (412) are of different flexural strengths. The flexural strength of each guide vane (412) impacts the degree to which a particular guide vane (412) will pivot about a pivot point (414). A guide vane with a greater flexural strength will tend to remain rigid when exposed to a force being exerted on the guide vanes (412) by airflow from the impeller (404). In contrast, a guide vane with a lower flexural strength will tend to remain less rigid when exposed to a force being exerted on the guide vanes (412) by airflow from the impeller (404). A guide vane with a greater flexural strength will therefore pivot about a pivot point to a greater degree than a guide vane with a lower flexural strength because a greater percentage of the force being exerted on a guide vane with a lower flexural strength will be absorbed by the guide vane in the form of flex, rather than utilized to pivot the guide vane about a pivot point. As such, the force being exerted on the guide vanes (412) by airflow from the impeller (404) will cause a guide vane with a lower flexural strength to be positioned differently than a guide vane with a greater flexural strength, thereby altering the distribution of airflow exiting the blower outlet (406). By taking the flexural strength of each guide vane (412) into account, the remaining physical attributes of the guide vanes (412) can be more precisely configured such that the force exerted on the guide vanes (412) causes the guide vanes (412) to pivot, or adjust, into a position that creates a more uniform distribution of airflow exiting the blower outlet (406).

In the example of FIG. 4, at least two of the guide vanes (412) are of different densities. The density of each guide vane (412) impacts the degree to which a particular guide vane (412) will pivot about a pivot point (414). That is, with all other factors being equal, a guide vane that is more dense will pivot less about a pivot point than a guide vane that is less dense as the result of a force being exerted on the guide vanes (412) by airflow from the impeller (404). As such, the force being exerted on the guide vanes (412) by airflow from the impeller (404) will cause a more dense guide vane to be positioned differently than a less dense guide vane, thereby altering the distribution of airflow exiting the blower outlet (406). By taking the density of each guide vane (412) into account, the remaining physical attributes of the guide vanes (412) can be more precisely configured such that the force exerted on the guide vanes (412) causes the guide vanes (412) to pivot, or adjust, into a position that creates a more uniform distribution of airflow exiting the blower outlet (406).

In the example of FIG. 4, the one or more pivot points (414) are adjustable. The pivot points (414) are adjustable in the sense that the pivot points (414) themselves may actually be repositioned. For example, the pivot points (414) may be mounted to the blower (402) in a groove such that the pivot points (414) may slide within the groove. Adjusting the pivot points (414) may therefore be carried out by sliding the pivot points (414) within the groove such that the location of the pivot points (414) is altered. The pivot points (414) may be adjusted, for example, through the use of automated machinery or in a purely mechanical implementation in which force imparted by the airflow generated by the impeller (404) causes the pivot points (414) to slide within a groove that the pivot points (414) are mounted within.

Figure 5A:
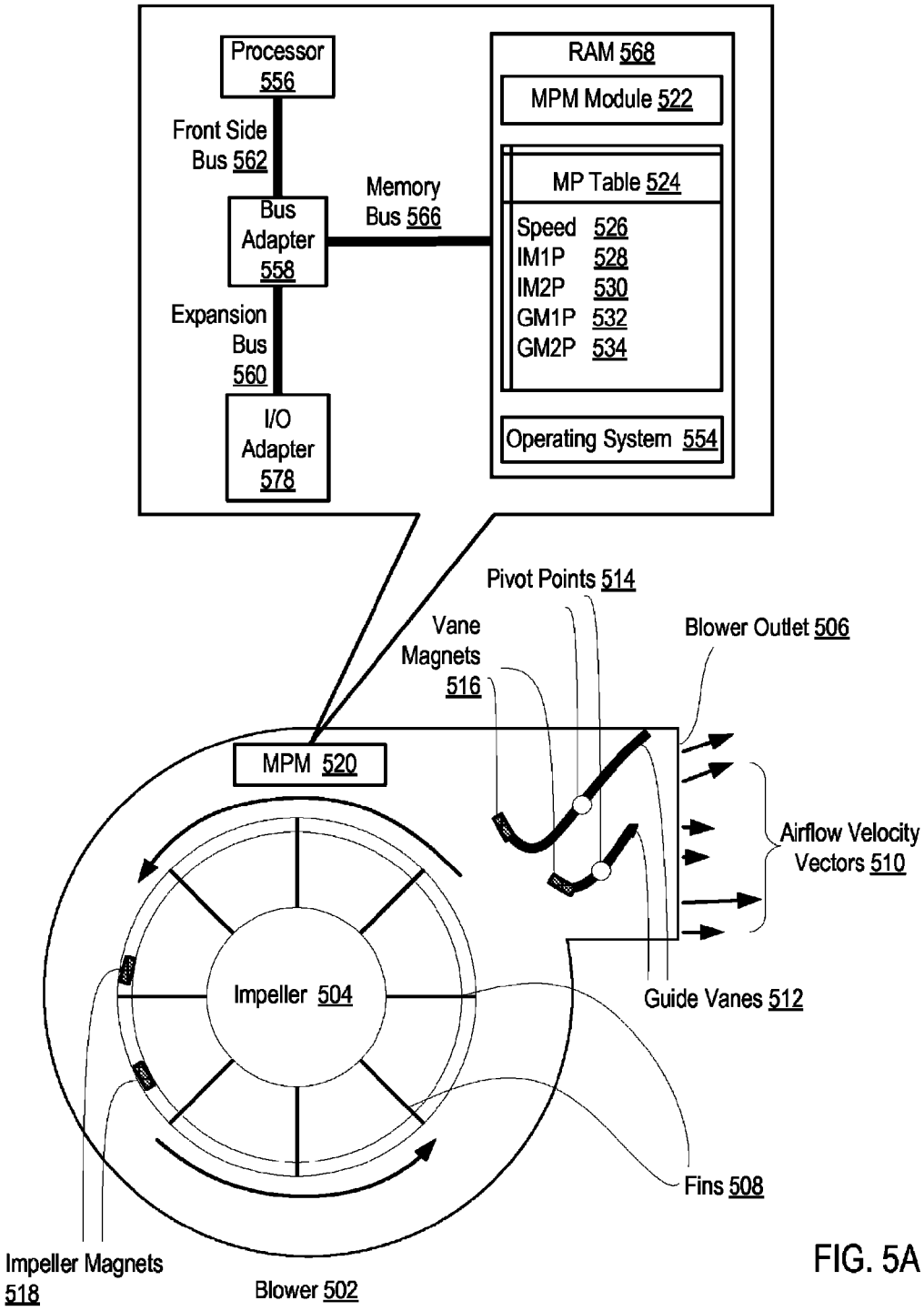
FIG. 5A sets forth a diagram of a further exemplary blower with adjustable guide vanes that are affixed to the blower at pivot points located in an outlet of the blower.

For further illustration, FIG. 5A sets forth a diagram of a blower (502) with adjustable guide vanes (512) that are affixed to the blower (502) at pivot points (514) located in an outlet (506) of the blower (502). The blower (502) of FIG. 5A includes an impeller (504) configured to rotate around a rotational center. When the impeller (504) is rotated the fins (508) cause air to be moved such that airflow exits the blower (502) via the blower outlet (506). The airflow that exits the blower (502) via the blower outlet (506) is illustrated by the airflow vectors (510) of FIG. 5A.

In the example of FIG. 5A, the impeller (504) includes one or more impeller magnets (518). In the example of FIG. 5A, only two impeller magnets (518) are illustrated. In some embodiments of the present invention, the impeller (504) may include additional impeller magnets (518) affixed to the impeller (504). The impeller magnets (518) of FIG. 5A may be embodied, for example, as a permanent magnet made from magnetized material that produces a persistent magnetic field, as an electromagnet that behaves as a magnet when electric current is applied to the electromagnet, or in any other way as will occur to those of skill in the art. In the example of FIG. 5A, the impeller (504) may include one or more closeable cells for housing the impeller magnets (518). Alternatively, the impeller magnets (518) may be permanently affixed to any surface of the impeller (504).

The blower (502) includes one or more adjustable guide vanes (512). Each of the one or more adjustable guide vanes (512) is affixed to the blower (502) at a pivot point (514). In the example of FIG. 5A, each of the one or more adjustable guide vanes (512) includes a vane magnet (516). The vane magnets (516) of FIG. 5A may be embodied, for example, as a permanent magnet made from magnetized material that produces a persistent magnetic field, as an electromagnet that behaves as a magnet when electric current is applied to the electromagnet, or in any other way as will occur to those of skill in the art. In the example of FIG. 5A, the adjustable guide vanes (512) may include one or more closeable cells for housing the vane magnets (516). Alternatively, the vane magnets (516) may be permanently affixed to any surface of the adjustable guide vanes (512).

In the example of FIG. 5A, a magnetic force exists between the one or more impeller magnets (518) and the one or more vane magnets (516). The magnetic force between the one or more impeller magnets (518) and the one or more vane magnets (516) of FIG. 5A causes the one or more adjustable guide vanes (512) to pivot about the one or more pivot points (514). Because the physical attributes of the adjustable guide vanes (512) are known, the magnetic elements included in the impeller (504) and in the adjustable guide vanes (512) may be chosen so that the magnetic force between the impeller magnets (518) and the one or more vane magnets (516) causes the guide vanes (512) to pivot, or adjust, into a position that creates a more uniform distribution of airflow exiting the blower outlet (506).

In the example of FIG. 5A, the impeller magnets (518) and the vane magnets (516) may be of the same polarity. When the impeller magnets (518) and the vane magnets (516) are of the same polarity, the magnetic force between the impeller magnets (518) and the vane magnets (516) would be a repulsive force causing the adjustable guide vanes (512) to pivot about the one or more pivot points (514) such that the distance between the impeller magnets (518) and the vane magnets (516) increases. Alternatively, the impeller magnets (518) and the vane magnets (516) of FIG. 5A may be of different polarities. When the impeller magnets (518) and the vane magnets (516) are of different polarities, the magnetic force between the impeller magnets (518) and the vane magnets (516) would be an attractive force causing the adjustable guide vanes (512) to pivot about the one or more pivot points (514) such that the distance between the impeller magnets (518) and the vane magnets (516) decreases. Because the physical attributes of the adjustable guide vanes (512) are known, the impeller magnets (518) and the vane magnets (516) may be selected such that the magnetic force between the impeller magnets (518) and the vane magnets (516) causes the adjustable guide vanes (512) to be positioned such that an airflow exit speed at each of one or more exit points is consistent within a predetermined range.

In the example of FIG. 5A, at least one of the impeller magnets (518) is encased within a closeable cell. In the example of FIG. 5A, at least one of the vane magnets (516) is also encased within a closeable cell. Because the cells are closeable, the magnetic force between the impeller magnets (518) and the vane magnets (516) may be decreased by closing the cells and thereby obstructing the impeller magnets (518) and the vane magnets (516) from exerting magnetic force on each other. Alternatively, the magnetic force between the impeller magnets (518) and the vane magnets (516) may be increased by opening the cells and thereby removing obstructions that prevent the impeller magnets (518) and the vane magnets (516) from exerting magnetic force on each other.

In the example of FIG. 5A, the closeable cells may be controlled in a purely mechanical fashion, for example, by designing the closeable cells on the impeller (504) to include a sliding cover such that the cells 'open' as the rotational speed of the impeller (504) increases and 'close' as the rotational speed of the impeller (504) decreases. As a further example, the closeable cells on the adjustable guide vanes (512) may include a sliding cover such that the cells 'open' as the guide vanes (512) pivot about the pivot points (514) in a first direction and 'close' as the guide vanes (512) pivot about the pivot points (514) in a second direction. For example, a cell may include an opening of 1 centimeter and a sliding cover that, when fully closed, completely closes the 1 centimeter opening.

In the example of FIG. 5A, the closeable cells may also be controlled in a non-mechanical fashion, for example, through the use of a magnetic profile manager (520). The magnetic profile manager (520) of FIG. 5A can be embodied as a module of automated computing machinery configured to control the magnetic force between the one or more impeller magnets (518) and the one or more vane magnets (516). The magnetic profile manager (520) of FIG. 5A includes at least one computer processor (556) or 'CPU' as well as random access memory (568) ('RAM') which is connected through a high speed memory bus (566) and bus adapter (558) to the processor (556) and to other components of the magnetic profile manager (520). The magnetic profile manager (520) may be embodied, for example, as a field programmable gate array (FPGA), application-specific integrated circuit (ASIC), complex programmable logic device (CPLD), or other special purpose module of automated computing machinery.

In the example of FIG. 5A, stored in RAM (568) is an operating system (554). Operating systems useful improving airflow from a blower with one or more adjustable guide vanes that are affixed to the blower at one or more pivot points located in an outlet of the blower according to embodiments of the present invention include UNIX™, Linux™, Microsoft XP™, AIX™, IBM's i5/OS™, and others as will occur to those of skill in the art. The operating system (554) and magnetic profile management module (522) in the example of FIG. 5A are shown in RAM (568), but such software may also be stored in any form of computer memory.

Also stored in RAM (568) is a magnetic profile management module (522), a module of computer program instructions for controlling the magnetic force between the one or more impeller magnets (518) and the one or more vane magnets (516). In the example of FIG. 5A, the magnetic profile management module (522) includes computer program instructions that, when executed, cause the magnetic profile management module (522) to determine a rotational speed of the impeller (504) in the blower (502). The magnetic profile management module (522) may determine a rotational speed of the impeller (504), for example, through the use of a tachometer configured to measure the rotational speed of the impeller (504).

In the example of FIG. 5A, the magnetic profile management module (522) also includes computer program instructions that, when executed, cause the magnetic profile management module (522) to adjust, in dependence upon the rotational speed of the impeller (504), the magnetic force between the one or more impeller magnets (518) and the one or more vane magnets (516). Adjusting the magnetic force between the one or more impeller magnets (518) and the one or more vane magnets (516) may be carried out, for example, by opening or closing a closeable cell that a particular magnet is mounted within. In the example of FIG. 5A, the magnetic profile management module (522) may use a magnetic profile table (524) to determine the extent to which a particular closeable cell that houses a magnet should be opened or closed. Table 2 illustrates an example of a magnetic profile table (524):

TABLE 2

Magnetic Profile Table

| Impeller Speed (Rot/Sec) | Impeller Magnet 1 Position (% closed) | Impeller Magnet 2 Position (% closed) | Vane Magnet 1 Position (% closed) | Vane Magnet 2 Position (% closed) |
|---|---|---|---|---|
| 0-.9 | 20 | 15 | 10 | 5 |
| 1-1.9 | 40 | 30 | 20 | 15 |
| 2-2.9 | 60 | 45 | 30 | 25 |
| 3-3.9 | 80 | 60 | 40 | 35 |
| 4+ | 100 | 75 | 50 | 45 |

The exemplary magnetic profile table (524) illustrated in Table 2 associates various impeller speeds (526) with positioning information (528) for a first impeller magnet, positioning information (530) for a second impeller magnet, positioning information (532) for a first guide vane magnet, and positioning information (534) for a second guide vane magnet. In the example of Table 2, the positioning information is expressed as a percentage at which a closeable cell that houses a particular magnet should be closed. For example, when the impeller speed is 1 rotation per second, the cell housing a first impeller magnet should 40% closed, the cell housing a second impeller magnet should be 30% closed, the cell housing a first guide vane magnet should 20% closed, and the cell housing a second guide vane magnet should 15% closed. Through the use of such a magnetic profile table (524), the magnetic profile management module (522) may determine the extent to which various cells should be closed, for example, using sliding covers as described above.

The magnetic profile manager (520) of FIG. 5A includes one or more input/output ('I/O') adapters (578). I/O adapters implement input/output through, for example, software drivers and computer hardware. In the example of FIG. 5A, the I/O adapter (578) may be a special purpose adapter that is useful for controlling the magnetic force between the one or more impeller magnets (518) and the one or more vane magnets (516). The I/O adapter (578) may be configured, for example, to receive input from a tachometer (not shown) capable of measuring the rotational speed of the impeller (504). The I/O adapter (578) of FIG. 5A can be configured to receive input from a tachometer, for example, through the use of DB9 connectors or another I/O interface capable of exchanging data between a tachometer and the magnetic profile manager (520).

Figure 5B:
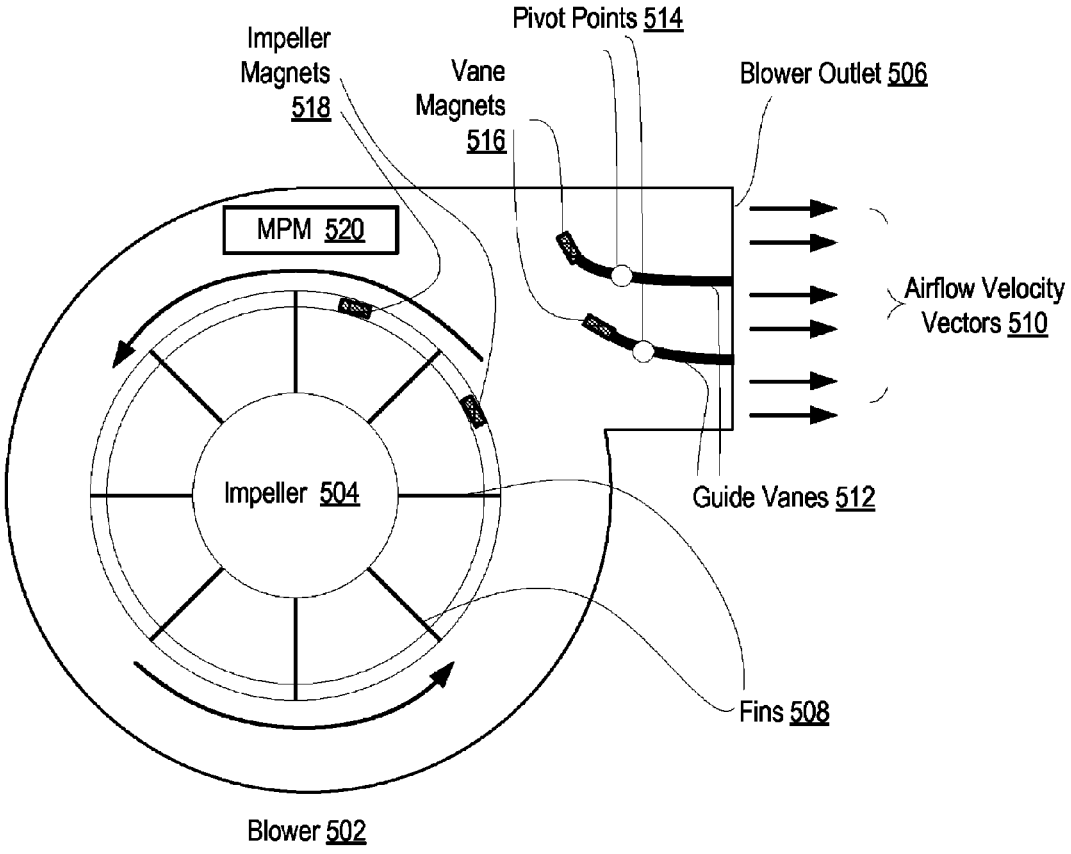
FIG. 5B sets forth a diagram of a further exemplary blower with adjustable guide vanes that are affixed to the blower at pivot points located in an outlet of the blower.

For further illustration, FIG. 5B sets forth a diagram of a blower (502) with adjustable guide vanes (512) that are affixed to the blower (502) at pivot points (514) located in an outlet (506) of the blower (502). The blower (502) of FIG. 5B is identical to the blower of FIG. 5A, including at it does, a magnetic profile manager (520), an impeller (504) with fins (508) and impeller magnets (518), as well as guide vanes (512) that rotate about pivot points (514) and include vane magnets (516). In the example of FIG. 5B, the impeller magnets (518) are closer to the vane magnets (516), due to impeller (504) rotation, such that the magnetic force between the impeller magnets (518) and the vane magnets (516) causes the guide vanes (512) to pivot about the pivot points (514) and be positioned differently than as illustrated in FIG. 5A, when the distance between the respective magnets was greater. Because the guide vanes (512) in FIG. 5B are positioned differently than as illustrated in FIG. 5A, the airflow velocity vectors (510) illustrate that airflow exiting the blower outlet (506) is also different than as illustrated in FIG. 5A. In order to facilitate less drastic differences in guide vane (512) positioning as is illustrated in FIGS. 5A and 5B, the number of impeller magnets (518) can be increased such that a more consistent magnetic force exists between the vane magnets (516) and the impeller magnets (518) as the impeller (504) rotates.

Figure 6:
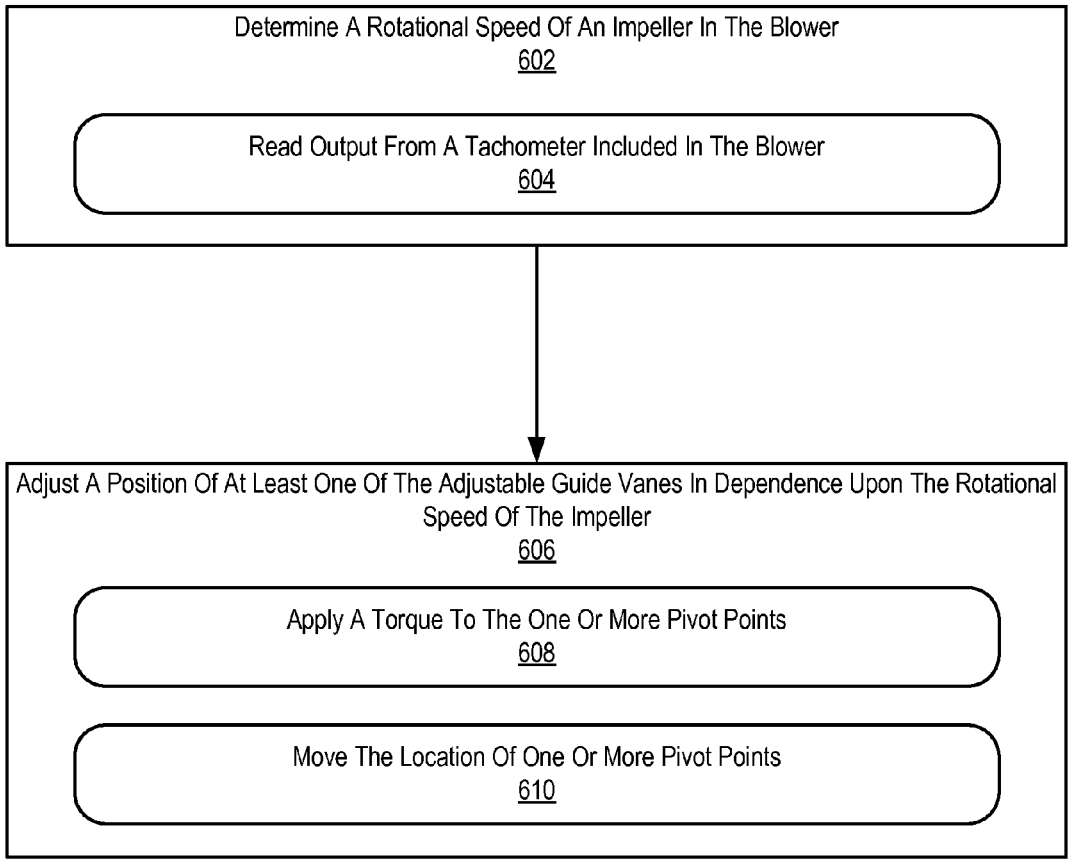
FIG. 6 sets forth a flow chart illustrating an exemplary method for improving airflow from a blower with one or more adjustable guide vanes that are affixed to the blower at one or more pivot points located in an outlet of the blower.

For further explanation, FIG. 6 sets forth a flow chart illustrating an exemplary method for improving airflow from a blower with one or more adjustable guide vanes that are affixed to the blower at one or more pivot points located in an outlet of the blower according to embodiments of the present invention. The example of FIG. 6 includes determining (602) a rotational speed of an impeller in the blower. In the example of FIG. 6, determining (602) the rotational speed of the impeller in the blower further comprises reading (604) the output of a tachometer included in the blower, as described above with reference to FIG. 3.

The example of FIG. 6 also includes adjusting (606) a position of at least one of the adjustable guide vanes in dependence upon the rotational speed of the impeller. In the example of FIG. 6, adjusting (606) a position of at least one of the adjustable guide vanes in dependence upon the rotational speed of the impeller may be carried out by applying (608) a torque to the one or more pivot points. In such an example, applying (608) a torque to the one or more pivot points causes the guide vane to move as the guide vane may be affixed to the pivot point such that rotating the pivot point causes the guide vane to also be rotated. In the example of FIG. 6, adjusting (606) a position of at least one of the adjustable guide vanes in dependence upon the rotational speed of the impeller may alternatively be carried out by moving (610) the location of the one or more pivot points. A pivot point may be adjustable, as described above with reference to FIG. 3, such that moving the location of the pivot point relative to the impeller causes the position of the one or more guide vanes to also be adjusted with respect to the impeller.

Figure 7:
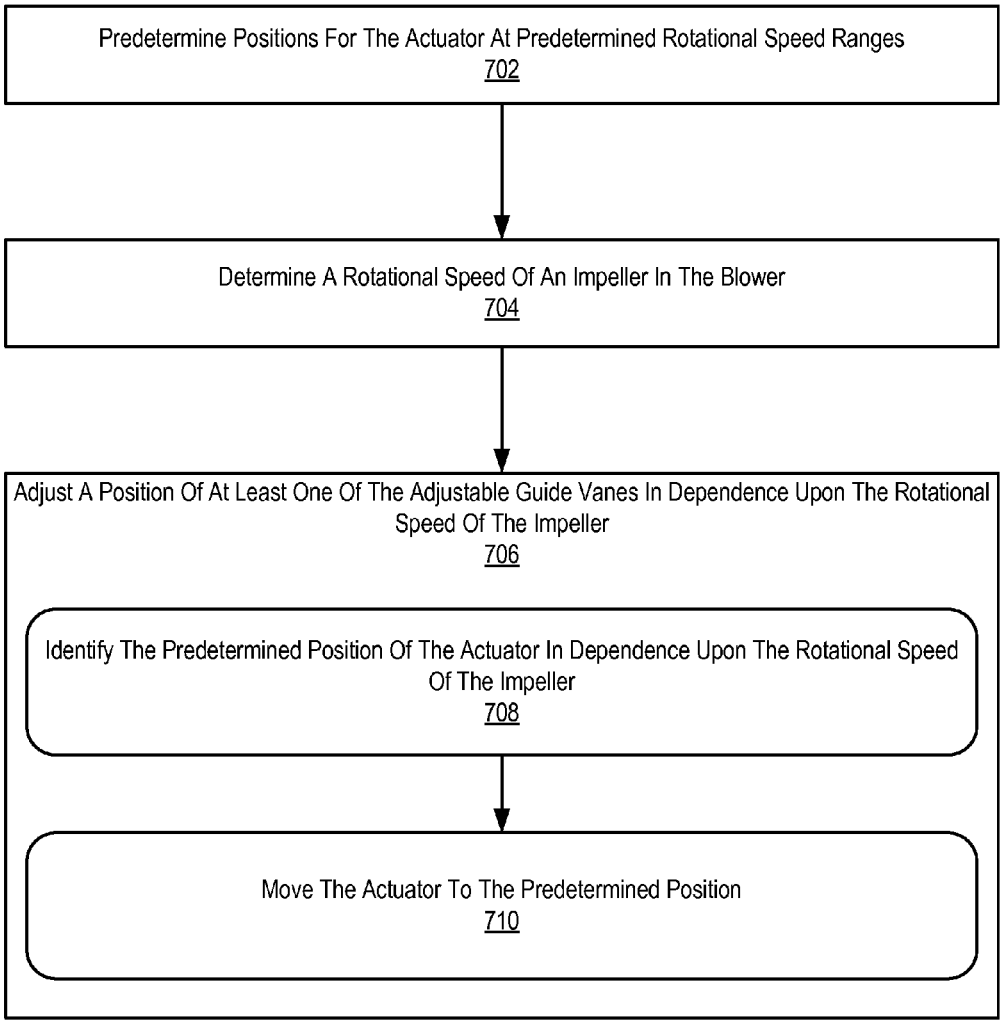
FIG. 7 sets forth a flow chart illustrating a further exemplary method for improving airflow from a blower with one or more adjustable guide vanes that are affixed to the blower at one or more pivot points located in an outlet of the blower.

For further explanation, FIG. 7 sets forth a flow chart illustrating an exemplary method for improving airflow from a blower with one or more adjustable guide vanes that are affixed to the blower at one or more pivot points located in an outlet of the blower. The example of FIG. 7 is similar to the example of FIG. 6, including as it does, determining (704) a rotational speed of an impeller in the blower and adjusting (706) a position of at least one of the adjustable guide vanes in dependence upon the rotational speed of the impeller. The example of FIG. 7 also includes predetermining (702) positions for the actuator at predetermined rotational speed ranges of the impeller. Predetermining (702) positions for the actuator at predetermined rotational speed ranges of the impeller may be carried out, for example, by constructing an airflow profile for various rotational speeds of the impeller. Using an airflow profile for a particular rotational speed of the impeller, the optimal positioning of guide vanes can be identified that produces the most uniform distribution of airflow via the blower's outlet. Because the guide vanes are attached to the actuator, the 'optimal' positioning of guide vanes corresponds to a particular position of the actuator, such as a particular percentage of full extension for the actuator. Predetermining (702) positions for the actuator at predetermined rotational speed ranges of the impeller is therefore carried out by determining particular positions of the actuator that correspond to 'optimal' positions of the guide vanes at predetermined rotational speed ranges of the impeller.

In the example of FIG. 7, adjusting (706) a position of at least one of the adjustable guide vanes in dependence upon the rotational speed of the impeller is carried out by identifying (708) the predetermined position of the actuator in dependence upon the rotational speed of the impeller and moving (710) the actuator to the predetermined position. In the example of FIG. 7, identifying (708) the predetermined position of the actuator in dependence upon the rotational speed of the impeller may be carried out, for example, by accessing an actuator positioning table that associates rotational speeds with predetermined optimal positions for the actuator as described above with reference to FIG. 3. Moving (710) the actuator to the predetermined position may be carried out, for example, by powering up an electronic motor that drives the actuator such that the actuator is displaced, thereby adjusting the position of the guide vanes.

Figure 8:
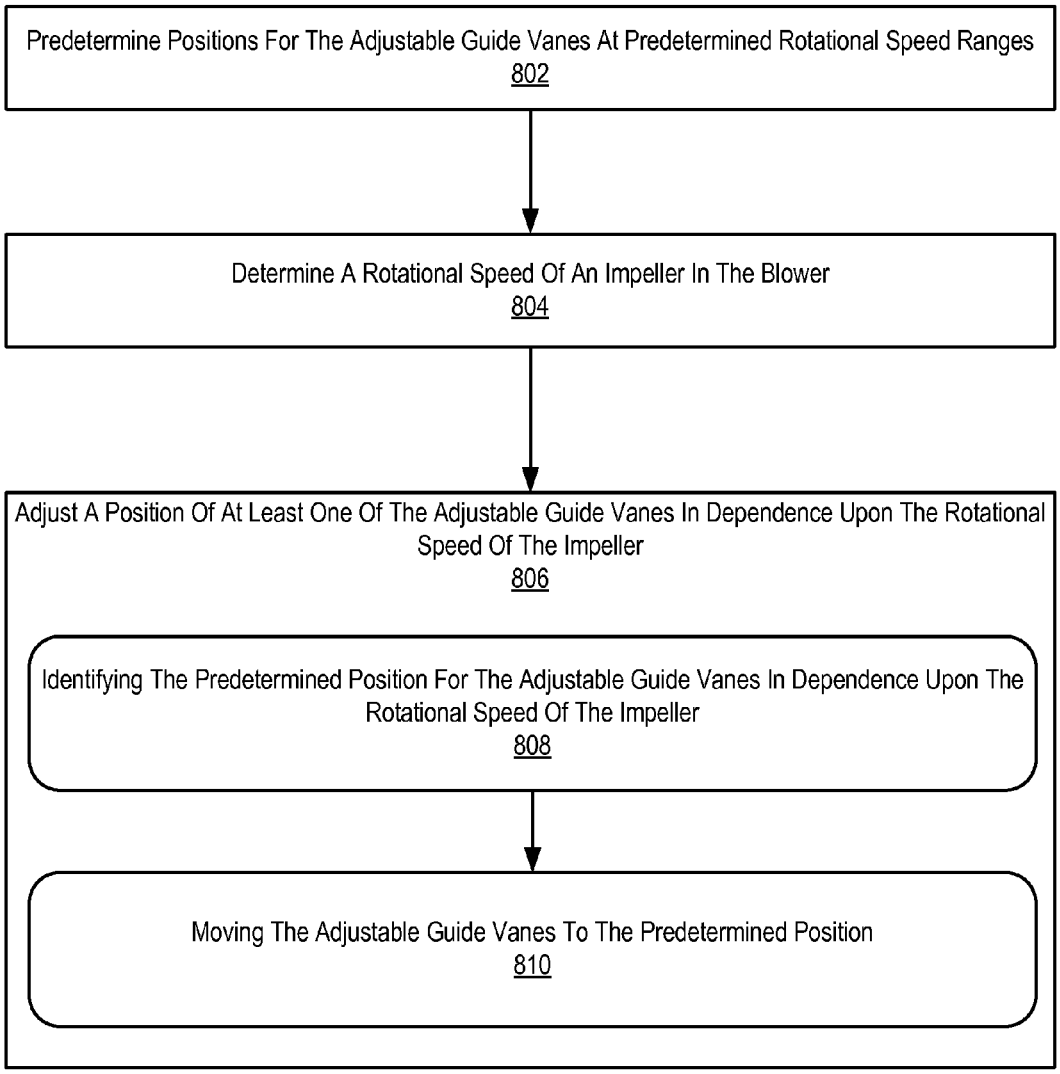
FIG. 8 sets forth a flow chart illustrating a further exemplary method for improving airflow from a blower with one or more adjustable guide vanes that are affixed to the blower at one or more pivot points located in an outlet of the blower.

For further explanation, FIG. 8 sets forth a flow chart illustrating an exemplary method for improving airflow from a blower with one or more adjustable guide vanes that are affixed to the blower at one or more pivot points located in an outlet of the blower. The example of FIG. 8 is similar to the example of FIG. 6, including as it does, determining (804) a rotational speed of an impeller in the blower and adjusting (806) a position of at least one of the adjustable guide vanes in dependence upon the rotational speed of the impeller. The example of FIG. 8 also includes predetermining (802) positions for the adjustable guide vanes at predetermined rotational speed ranges of the impeller. Predetermining (802) positions for the adjustable guide vanes at predetermined rotational speed ranges of the impeller may be carried out, for example, by constructing an airflow profile for various rotational speeds of the impeller. Using an airflow profile for a particular rotational speed of the impeller, the 'optimal' positioning of guide vanes can be identified that produces the most uniform distribution of airflow via the blower's outlet.

In the example of FIG. 8, adjusting (806) a position of at least one of the adjustable guide vanes in dependence upon the rotational speed of the impeller is carried out by identifying (808) the predetermined position for the adjustable guide vanes in dependence upon the rotational speed of the impeller and moving (810) the guide vane to the predetermined position. In the example of FIG. 8, identifying (808) the predetermined position for the adjustable guide vanes in dependence upon the rotational speed of the impeller may be carried out, for example, by accessing a guide vane positioning table that associates rotational speeds with predetermined optimal positions for the guide vanes. Moving (810) the guide vane to the predetermined position may be carried out, for example, by powering up an electronic motor that drives an actuator that is attached to the guide vanes, by applying a torque to pivot points of the guide vanes, and in other ways as will occur to those of skill in the art.

Figure 9:
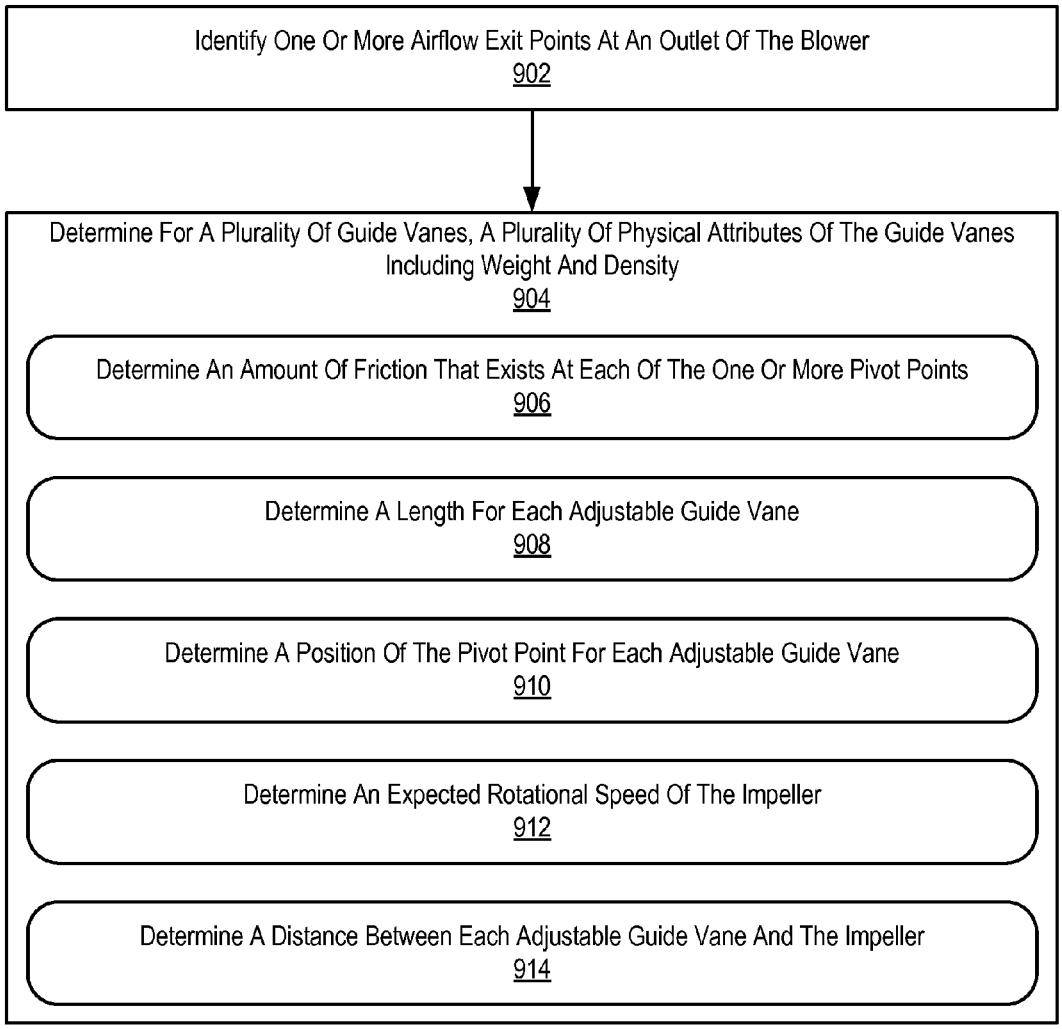
FIG. 9 sets forth a flow chart illustrating a further exemplary method for improving airflow from a blower with adjustable guide vanes that are affixed to the blower at one or more pivot points located in an outlet of the blower.

For further explanation, FIG. 9 sets forth a flow chart illustrating a further exemplary method for improving airflow from a blower with adjustable guide vanes that are affixed to the blower at one or more pivot points located in an outlet of the blower, according to embodiments of the present invention. The example of FIG. 9 includes identifying (902) one or more airflow exit points at an outlet of the blower. Identifying (902) one or more airflow exit points at an outlet of the blower may be carried out, for example, by dividing the height or width of the blower outlet by a predetermined number and spacing the exit points at consistent intervals that will subsequently be used as reference points for measuring the airflow exiting the blower outlet.

The example of FIG. 9 also includes determining (904) for a plurality of guide vanes, a plurality of physical attributes of the guide vanes. The plurality of physical attributes of the guide vanes includes weight and density. The plurality of physical attributes are determined such that a force exerted by airflow exiting the outlet of the blower causes each adjustable guide vane to be positioned such that the airflow exit speed at each of the one or more exit points is consistent within a predetermined range. In the example of FIG. 9, at least two of the guide vanes have different physical attributes. For example, at least two of the guide vanes may be weighted differently, may be of different densities, and so on.

In the example of FIG. 9, each of the guide vanes may pivot about a pivot point. As such, the force exerted on the guide vanes by airflow generated by the impeller causes the guide vanes to pivot about a pivot point. By determining the amount of airflow that will be generated by the impeller, the physical attributes of the guide vanes can be determined such that the force exerted on the guide vanes by airflow generated by the impeller causes the guide vanes to pivot about a pivot point in a way that causes a more uniform distribution of airflow via the blower outlet.

For example, the guide vanes may be designed such that when the impeller is not rotating, the weight, density, and other physical attributes of the guide vanes causes the guide vanes to pivot about the pivot points such that the guide vanes are in a 'closed' position, meaning that airflow does not enter or exit the blower through the blower outlet. Once the impeller begins rotating, airflow is generated from the impeller. This airflow generated by the impeller exerts a force of the guide vanes that causes the guide vanes to pivot about the pivot points. If, for example, the impeller is always rotated at a constant speed when powered on, the amount of airflow generated by the impeller can be measured and the amount of force that such airflow exerts on the guide vanes can also be determined. Because the amount of force exerted on the guide vanes is known, the physical attributes of the guide vanes can be configured such that the force exerted on the guide vanes causes the guide vanes to pivot, or adjust, into a position that creates a more uniform distribution of airflow exiting the blower outlet.

In the example of FIG. 9, determining (904) a plurality of physical attributes of the guide vanes may include determining (906) an amount of friction that exists at each of the one or more pivot points. The amount of friction that exists at each of the one or more pivot points impacts the degree to which a particular guide vane will pivot about a pivot point. That is, with all other factors being equal, a guide vane that is connected to a pivot point with a higher friction coefficient will rotate less than a physically identical guide vane that is connected to a pivot point with a lower friction coefficient. As such, the force being exerted on the guide vanes by airflow from the impeller will cause the guide vane that is connected to a pivot point with a higher friction coefficient to be positioned differently than a physically identical guide vane that is connected to a pivot point with a lower friction coefficient, thereby altering the distribution of airflow exiting the blower outlet. By taking the amount of friction that exists at each of the one or more pivot points into account, the physical attributes of the guide vanes can be more precisely configured such that the force exerted on the guide vanes causes the guide vanes to pivot, or adjust, into a position that creates a more uniform distribution of airflow exiting the blower outlet.

In the example of FIG. 9, determining (904) a plurality of physical attributes of the guide vanes may include determining (908) a length for each adjustable guide vane. The length of the guide vanes impacts the degree to which a particular guide vane will pivot about a pivot point. That is, with all other factors being equal, a shorter guide vane will pivot less about a pivot point than a longer guide vane as the result of a force being exerted on the guide vanes by airflow from the impeller. As such, the force being exerted on the guide vanes by airflow from the impeller will cause a shorter guide vane will be positioned differently than a longer guide vane, thereby altering the distribution of airflow exiting the blower outlet.

In the example of FIG. 9, determining (904) a plurality of physical attributes of the guide vanes may include determining (910) a position of the pivot point for each adjustable guide vane. The position of the pivot point for each adjustable guide vane impacts the degree to which a particular guide vane will pivot about a pivot point. That is, the degree to which two physically identical guide vanes with pivot points located at different positions (relative to each guide vane) will pivot about each pivot, in response to identical forces being exerted on each guide vane, is different because the lever arm that the force is applied to is different. By taking the position of the pivot point for each adjustable guide vane into account, the physical attributes of the guide vanes can be more precisely configured such that the force exerted on the guide vanes causes the guide vanes to pivot, or adjust, into a position that creates a more uniform distribution of airflow exiting the blower outlet.

In the example of FIG. 9, determining (904) a plurality of physical attributes of the guide vanes may include determining (912) an expected rotational speed of the impeller. The rotational speed of the impeller impacts the degree to which a particular guide vane will pivot about a pivot point. As described above, when the impeller is rotating, airflow is generated from the impeller. This airflow generated by the impeller exerts a force of the guide vanes that causes the guide vanes to pivot about the pivot points. With all other factors being equal, an impeller rotating at a faster speed will generate more airflow that will exert a greater force on a particular guide vane than a physically identical impeller rotating at a slower speed. By taking the rotational speed of the impeller into account, the physical attributes of the guide vanes can be more precisely configured such that the force exerted on the guide vanes causes the guide vanes to pivot, or adjust, into a position that creates a more uniform distribution of airflow exiting the blower outlet.

In the example of FIG. 9, determining (904) a plurality of physical attributes of the guide vanes may include determining (914) a distance between each adjustable guide vane and the impeller. The distance between each adjustable guide vane and the impeller impacts the degree to which a particular guide vane will pivot about a pivot point. With all other factors being equal, airflow generated by an impeller rotating at a particular speed will exert a greater force on a guide vane that is closer to the impeller than would be exerted on a physically identical guide vane that is further from the impeller. By taking the distance between each adjustable guide vane and the impeller into account, the physical attributes of the guide vanes can be more precisely configured such that the force exerted on the guide vanes causes the guide vanes to pivot, or adjust, into a position that creates a more uniform distribution of airflow exiting the blower outlet.

Figure 10:
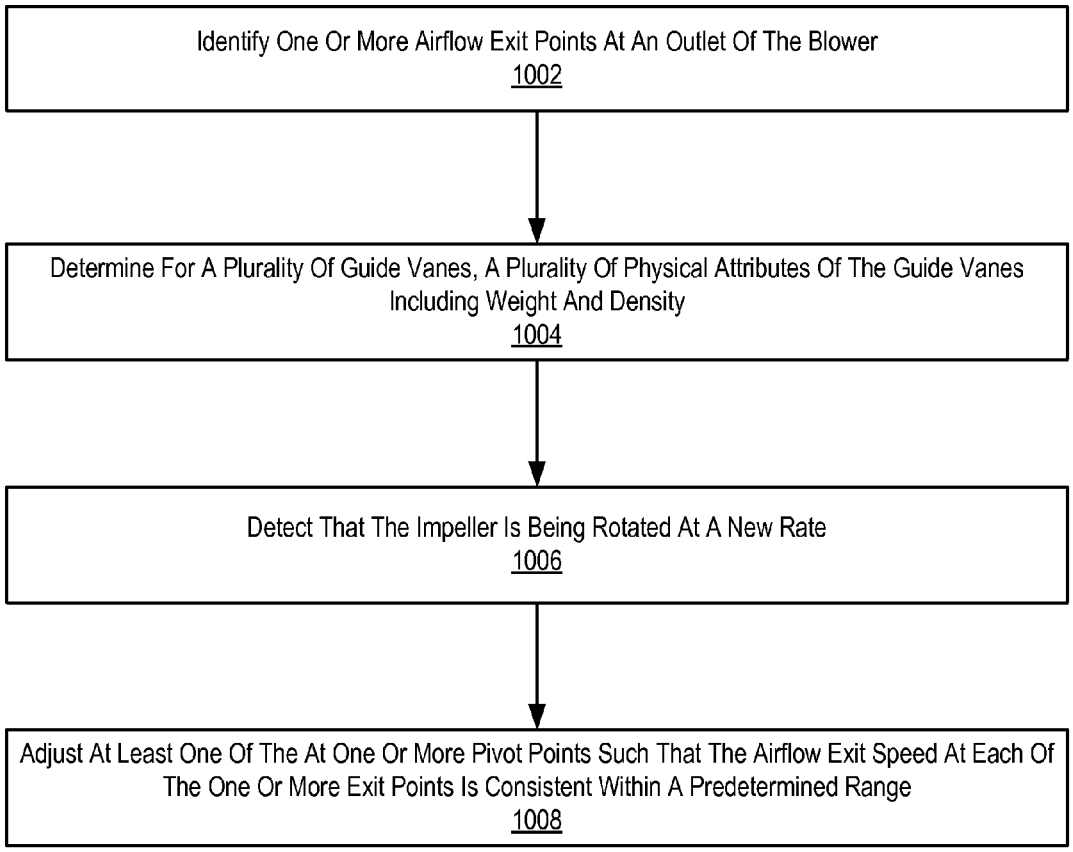
FIG. 10 sets forth a flow chart illustrating a further exemplary method for improving airflow from a blower with adjustable guide vanes that are affixed to the blower at one or more pivot points located in an outlet of the blower.

For further explanation, FIG. 10 sets forth a flow chart illustrating a further exemplary method for improving airflow from a blower with adjustable guide vanes that are affixed to the blower at one or more pivot points located in an outlet of the blower, according to embodiments of the present invention. The example of FIG. 10 is similar to the example of FIG. 9, including as it does, identifying (1002) one or more airflow exit points at an outlet of the blower and determining (1004) for a plurality of guide vanes, a plurality of physical attributes of the guide vanes including weight and density. The example of FIG. 10 also includes detecting (1006) that the impeller is being rotated at a new rate. Detecting (1006) that the impeller is being rotated at a new rate may be carried out, for example, through the use of an tachometer configured to measure the rotational speed of the impeller.

The example of FIG. 10 also includes adjusting (1008) at least one of the pivot points such that the airflow exit speed at each of the one or more exit points is consistent within a predetermined range. The pivot points of a blower may be adjusted by sliding the pivot points within a groove such that the location of the pivot points is altered, for example, as described above with reference to FIG. 4. As such, the position of the at one or more pivot points may be adjusted in response to detecting that the impeller is being rotated at a new rate such that the airflow exit speed at each of the one or more exit points is consistent within a predetermined range.

Figure 11:
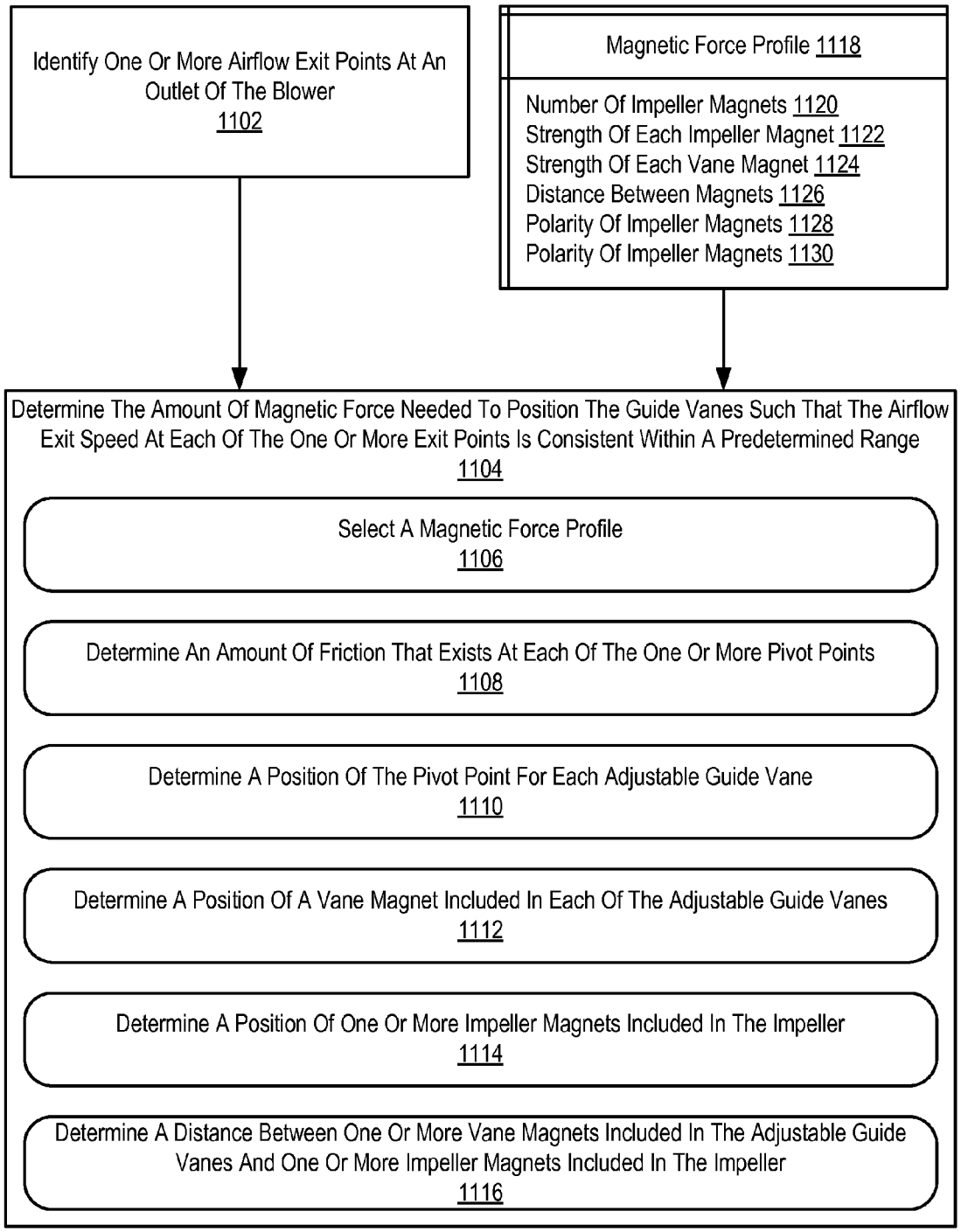
FIG. 11 sets forth a flow chart illustrating a further exemplary method of improving airflow from a blower with adjustable guide vanes that are affixed to the blower at one or more pivot points located in an outlet of the blower.

For further explanation, FIG. 11 sets forth a flow chart illustrating an exemplary method of improving airflow from a blower with adjustable guide vanes that are affixed to the blower at one or more pivot points located in an outlet of the blower according to embodiments of the present application. In the example of FIG. 11, an impeller in the blower includes one or more magnetic elements and each adjustable guide vane also includes one or more magnetic elements. A magnetic element is any object that produces a magnetic field such as, for example, a magnet. In the example of FIG. 11, a magnetic force exists between the one or more magnetic elements of the impeller and the one or more magnetic elements of the adjustable guide vanes. The magnetic force between the one or more magnetic elements of the impeller and the one or more magnetic elements of the adjustable guide vanes causes the one or more adjustable guide vanes to pivot about the one or more pivot points. Because the physical attributes of the adjustable guide vanes are known, the one or more magnetic elements of the impeller and the one or more magnetic elements of the adjustable guide vanes may be chosen so that the magnetic force between the one or more magnetic elements of the impeller and the one or more magnetic elements of the adjustable guide vanes causes the guide vanes to pivot, or adjust, into a position that creates a more uniform distribution of airflow exiting the blower outlet.

The example of FIG. 11 includes identifying (1102) one or more airflow exit points at an outlet of the blower. Identifying (1102) one or more airflow exit points at an outlet of the blower may be carried out, for example, by dividing the height or width of the blower outlet by a predetermined number and spacing the exit points at consistent intervals that will subsequently be used as reference points for measuring the airflow exiting the blower outlet.

The example of FIG. 11 also includes determining (1104) the amount of magnetic force needed to position the guide vanes such that the airflow exit speed at each of the one or more exit points is consistent within a predetermined range. Determining (1104) the amount of magnetic force needed to position the guide vanes such that the airflow exit speed at each of the one or more exit points is consistent within a predetermined range may be carried out by constructing an airflow profile for various rotational speeds of the impeller. Using an airflow profile for a particular rotational speed of the impeller, the 'optimal' positioning of guide vanes can be identified that produces the most uniform distribution of airflow via the blower's outlet. Because the physical attributes of the guide vanes are known, a magnetic force that would cause the guide vanes to pivot, or adjust, around a pivot point such that each guide vane would be in its 'optimal' position can be calculated.

In the example of FIG. 11, determining (1104) the amount of magnetic force needed to position the guide vanes such that the airflow exit speed at each of the one or more exit points is consistent within a predetermined range may include selecting (1106) a magnetic force profile (1118). The magnetic force profile (1118) includes information useful in determining the amount of magnetic force that exists between magnetic elements in an impeller and a magnetic element in an adjustable guide vane. In the example of FIG. 11, the magnetic force profile (1118) includes at least one of: a number (1120) of impeller magnets, a strength (1122) of each impeller magnet, a strength (1124) of a guide vane magnet, a distance (1126) between at least one impeller magnet and at least one guide vane magnet, a polarity (1128) of at least one impeller magnet, and a polarity (1130) of at least one guide vane magnet. The strength (1122) of each impeller magnet and the strength (1124) of a guide vane magnet may be represented, for example, by the magnetic moment of each magnet. The distance (1126) between at least one impeller magnet and at least one guide vane magnet may be embodied, for example, as the average distance between the two magnets as the impeller rotates, the closest distance between the two magnets as the impeller rotates, and so on.

In the example of FIG. 11, determining (1104) the amount of magnetic force needed to position the guide vanes such that the airflow exit speed at each of the one or more exit points is consistent within a predetermined range may include determining (1108) an amount of friction that exists at each of the one or more pivot points. The amount of friction that exists at each of the one or more pivot points impacts the degree to which a particular guide vane will pivot about a pivot point. That is, with all other factors being equal, a guide vane that is connected to a pivot point with a higher friction coefficient will rotate less than a physically identical guide vane that is connected to a pivot point with a lower friction coefficient. As such, the magnetic force exerted on a guide vane that is connected to a pivot point with a higher friction coefficient must be greater than the magnetic force exerted on a physically identical guide vane that is connected to a pivot point with a lower friction coefficient in order to effect the same amount of rotation about the pivot point for each guide vane. By taking the amount of friction that exists at each of the one or more pivot points into account, the amount of magnetic force needed to position the guide vanes as desired can be more precisely configured such that the force exerted on the guide vanes causes the guide vanes to pivot, or adjust, into a position that creates a more uniform distribution of airflow exiting the blower outlet.

In the example of FIG. 11, determining (1104) the amount of magnetic force needed to position the guide vanes such that the airflow exit speed at each of the one or more exit points is consistent within a predetermined range may include determining (1110) a position of the pivot point for each of the adjustable guide vanes. The position of the pivot point for each adjustable guide vane impacts the degree to which a particular guide vane will pivot about a pivot point. That is, the degree to which two physically identical guide vanes with pivot points located at different positions (relative to each guide vane) will pivot about each pivot, in response to identical forces being exerted on each guide vane, is different because the lever arm that the force is applied to is different. By taking the position of the pivot point for each adjustable guide vane into account, the amount of magnetic force needed to position the guide vanes as desired can be more precisely configured such that the force exerted on the guide vanes causes the guide vanes to pivot, or adjust, into a position that creates a more uniform distribution of airflow exiting the blower outlet.

In the example of FIG. 11, determining (1104) the amount of magnetic force needed to position the guide vanes such that the airflow exit speed at each of the one or more exit points is consistent within a predetermined range may include determining (1112) a position of a vane magnet included in each of the adjustable guide vanes. The position of a vane magnet included in each of the adjustable guide vanes impacts the magnetic force between the vane magnet and magnetic elements within the impeller, thereby impacting the degree to which a particular guide vane will pivot about a pivot point. For example, with all other factors being equal, the magnetic force between a vane magnet that is at a first position within an adjustable guide vane is greater than the magnetic force between a vane magnet that is at a second position within an adjustable guide vane when the distance between the first position and the magnetic elements in the impeller is less than the second position and the magnetic elements in the impeller. In addition, with all other factors being equal, the degree to which a particular guide vane will pivot about a pivot point is increased for a vane magnet that is at a first position within an adjustable guide vane than a vane magnet that is at a second position within an adjustable guide vane when the first position is further away from the pivot point than the second position, as the result of a longer lever arm. By taking the position of a vane magnet included in each of the adjustable guide vanes into account, the amount of magnetic force needed to position the guide vanes as desired can be more precisely configured such that the force exerted on the guide vanes causes the guide vanes to pivot, or adjust, into a position that creates a more uniform distribution of airflow exiting the blower outlet.

In the example of FIG. 11, determining (1104) the amount of magnetic force needed to position the guide vanes such that the airflow exit speed at each of the one or more exit points is consistent within a predetermined range may include determining (1114) a position of one or more impeller magnets included in the impeller. The position of one or more impeller magnets included in the impeller impacts the degree to which a particular guide vane will pivot about a pivot point. For example, the minimum distance between a magnetic element in a particular guide vane and a magnet located on the exterior surface of a rotating impeller may be less than the minimum distance between the same magnetic element in the same particular guide vane and a magnet located on the interior surface of a rotating impeller. As such, with all other factors being equal, the magnetic force between a magnetic element in a particular guide vane and a magnet located on the exterior surface of a rotating impeller will be greater than the minimum distance between the same magnetic element in the same particular guide vane and a magnet located on the interior surface of a rotating impeller. By taking the position of one or more impeller magnets included in the impeller into account, the amount of magnetic force needed to position the guide vanes as desired can be more precisely configured such that the force exerted on the guide vanes causes the guide vanes to pivot, or adjust, into a position that creates a more uniform distribution of airflow exiting the blower outlet.

In the example of FIG. 11, determining (1104) the amount of magnetic force needed to position the guide vanes such that the airflow exit speed at each of the one or more exit points is consistent within a predetermined range may include determining (1116) a distance between one or more vane magnets included in the adjustable guide vanes and one or more impeller magnets included in the impeller. The distance between one or more vane magnets included in the adjustable guide vanes and one or more impeller magnets included in the impeller impacts the degree to which a particular guide vane will pivot about a pivot point. For example, with all other things being equal, the magnetic force between a vane magnet and an impeller magnet is increased as the distance between the two magnets is decreased, thereby impacting the degree to which a particular guide vane that includes the vane magnet will pivot about a pivot point. By taking the distance between one or more vane magnets included in the adjustable guide vanes and one or more impeller magnets included in the impeller into account, the amount of magnetic force needed to position the guide vanes as desired can be more precisely configured such that the force exerted on the guide vanes causes the guide vanes to pivot, or adjust, into a position that creates a more uniform distribution of airflow exiting the blower outlet.

Figure 12:
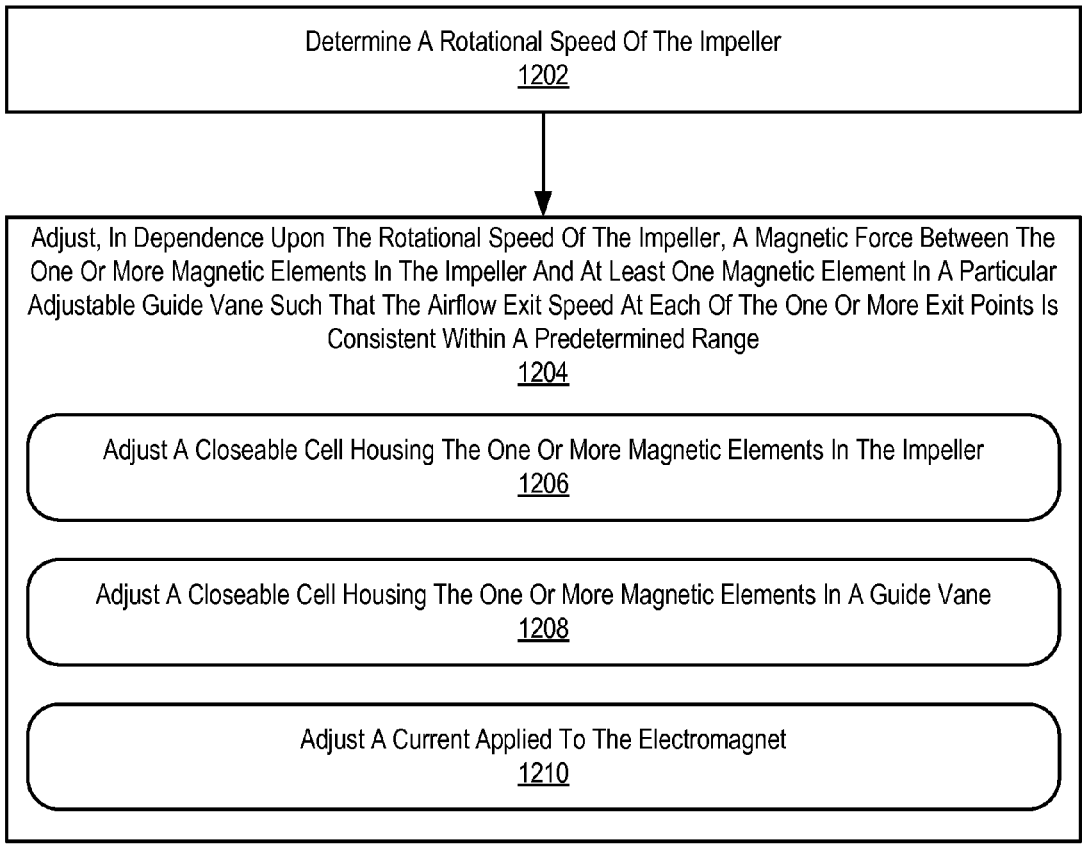
FIG. 12 sets forth a flow chart illustrating a further exemplary method of improving airflow from a blower with adjustable guide vanes that are affixed to the blower at one or more pivot points located in an outlet of the blower.

For further explanation, FIG. 12 sets forth a flow chart illustrating an exemplary method of improving airflow from a blower with adjustable guide vanes that are affixed to the blower at one or more pivot points located in an outlet of the blower. In the example of FIG. 12, the impeller in the blower includes one or more magnetic elements and each adjustable guide vane also includes one or more magnetic elements. The example of FIG. 12 includes determining (1202) a rotational speed of the impeller. Determining (1202) a rotational speed of the impeller may be carried out, for example, using a tachometer configured to measure the rotational speed of the impeller.

The example of FIG. 12 also includes adjusting (1204), in dependence upon the rotational speed of the impeller, a magnetic force between the one or more magnetic elements in the impeller and at least one magnetic element in a particular adjustable guide vane such that the airflow exit speed at each of the one or more exit points is consistent within a predetermined range. In the example of FIG. 12, the one or more magnetic elements in the impeller may be encased within a closeable cell. In such an example, adjusting (1204) the magnetic force between the one or more magnetic elements in the impeller and at least one magnetic element in a particular adjustable guide vane may include adjusting (1206) the closeable cell. Adjusting (1206) the closeable cell may be carried out, for example, through the use of automated computing machinery configured to control the operation the closeable cell, such as the magnetic profile manager described above with reference to FIG. 5A.

In the example of FIG. 12, at least one magnetic element in a particular adjustable guide vane may be encased within a closeable cell. In such an example, adjusting (1204) the magnetic force between the one or more magnetic elements in the impeller and at least one magnetic element in a particular adjustable guide vane may include adjusting (1208) the closeable cell. Adjusting (1208) the closeable cell may be carried out, for example, through the use of automated computing machinery configured to control the operation the closeable cell, such as the magnetic profile manager described above with reference to FIG. 5A.

In the example of FIG. 12, the one or more magnetic elements in the impeller may be electromagnets. In such an example, adjusting (1204) a magnetic force between the one or more magnetic elements in the impeller and at least one magnetic element in a particular adjustable guide vane may include adjusting (1210) a current applied to the electromagnet. Adjusting (1210) a current applied to the electromagnet may be carried out, for example, through the use of automated computing machinery configured to control operation of a power supply or other power source that delivers current to the electromagnet, such as the magnetic profile manager described above with reference to FIG. 5A.

Exemplary embodiments of the present invention are described largely in the context of a fully functional apparatus and method for improving airflow from a blower with one or more adjustable guide vanes that are affixed to the blower at one or more pivot points located in an outlet of the blower. Readers of skill in the art will recognize, however, that the present invention also may be embodied in a computer program product disposed upon computer readable storage media for use with any suitable data processing system. Such computer readable storage media may be any storage medium for machine-readable information, including magnetic media, optical media, or other suitable media. Examples of such media include magnetic disks in hard drives or diskettes, compact disks for optical drives, magnetic tape, and others as will occur to those of skill in the art. Persons skilled in the art will immediately recognize that any computer system having suitable programming means will be capable of executing the steps of the method of the invention as embodied in a computer program product. Persons skilled in the art will recognize also that, although some of the exemplary embodiments described in this specification are oriented to software installed and executing on computer hardware, nevertheless, alternative embodiments implemented as firmware or as hardware are well within the scope of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A method of improving airflow from a blower with adjustable guide vanes that are affixed to the blower at one or more pivot points located in an outlet of the blower, wherein an impeller in the blower includes one or more magnetic elements and wherein each adjustable guide vane includes one or more magnetic elements, the method comprising:

identifying one or more airflow exit points at the outlet of the blower; and determining an amount of magnetic force needed to position the adjustable guide vanes such that the airflow exit speed at each of the one or more airflow exit points is consistent within a predetermined range.

2. The method of claim 1, wherein determining the amount of magnetic force needed to position the adjustable guide vanes such that the airflow exit speed at each of the one or more airflow exit points is consistent within a predetermined range further comprises selecting a magnetic force profile.

3. The method of claim 2, wherein the magnetic force profile includes at least one of: a number of active impeller magnets, a strength of each active impeller magnet, a strength of a guide vane magnet, a distance between at least one active impeller magnet and at least one guide vane magnet, a polarity of at least one active impeller magnet, and a polarity of at least one guide vane magnet.

4. The method of claim 1, wherein determining the amount of magnetic force needed to position the adjustable guide vanes such that the airflow exit speed at each of the one or more airflow exit points is consistent within a predetermined range further comprises determining an amount of friction that exists at each of the one or more pivot points.

5. The method of claim 1, wherein determining the amount of magnetic force needed to position the adjustable guide vanes such that the airflow exit speed at each of the one or more airflow exit points is consistent within a predetermined range further comprises determining a position of the pivot point for each of the adjustable guide vanes.

6. The method of claim 1, wherein determining the amount of magnetic force needed to position the adjustable guide vanes such that the airflow exit speed at each of the one or more airflow exit points is consistent within a predetermined range further comprises determining a position of a vane magnet included in each of the adjustable guide vanes.

7. The method of claim 1, wherein determining the amount of magnetic force needed to position the adjustable guide vanes such that the airflow exit speed at each of the one or more airflow exit points is consistent within a predetermined range further comprises determining a position of one or more impeller magnets included in the impeller.

8. The method of claim 1, wherein determining the amount of magnetic force needed to position the adjustable guide vanes such that the airflow exit speed at each of the one or more airflow exit points is consistent within a predetermined range further comprises determining a distance between one or more vane magnets included in the adjustable guide vanes and one or more impeller magnets included in the impeller.

9. A blower with one or more adjustable guide vanes that are affixed to the blower at one or more pivot points located in an outlet of the blower, the blower comprising:

an impeller configured to rotate around a rotational center, wherein the impeller includes one or more impeller magnets; and one or more adjustable guide vanes, wherein each of the one or more adjustable guide vanes includes one or more vane magnets;

wherein the rotation of the impeller provides a magnetic force between the one or more impeller magnets and the one or more vane magnets that causes the one or more guide vanes to be positioned such that an airflow exit speed at each of one or more exit points is consistent within a predetermined range.

10. The blower of claim 9, wherein the one or more impeller magnets are of a same polarity as the one or more vane magnets.

11. The blower of claim 9, wherein the one or more impeller magnets are of an opposite polarity as the one or more vane magnets.

12. The blower of claim 9, wherein at least one of the vane magnets is encased within a closeable cell.

13. The blower of claim 9, wherein at least one of the one or more impeller magnets is encased within a closeable cell.

14. The blower of claim 9, further comprising a magnetic profile management module, wherein magnetic profile management module includes computer program instructions for:

determining a rotational speed of an impeller in the blower; and adjusting, in dependence upon the speed, the magnetic force between the one or more impeller magnets and the one or more vane magnets thereby causing the one or more guide vanes to be positioned such that an airflow exit speed at each of one or more exit points is consistent within a predetermined range.

15. A computer program product for improving airflow from a blower with adjustable guide vanes that are affixed to the blower at one or more pivot points located in an outlet of the blower, the computer program product disposed upon a computer readable non-transitory storage medium, the computer program product comprising computer program instructions that when executed by a computer cause the computer to carry out the steps of:

identifying one or more airflow exit points at the outlet of the blower; and determining an amount of magnetic force needed to position the adjustable guide vanes such that airflow exit speed at each of the one or more airflow exit points is consistent within a predetermined range.

16. The computer program product of claim 15 wherein computer program instructions that when executed by a computer cause the computer to carry out the steps of determining the amount of magnetic force needed to position the adjustable guide vanes such that the airflow exit speed at each of the one or more airflow exit points is consistent within a predetermined range further comprises computer program instructions that when executed by a computer cause the computer to carry out the steps of determining a weight of each of the adjustable guide vanes.

17. The computer program product of claim 15 wherein computer program instructions that when executed by a computer cause the computer to carry out the steps of determining the amount of magnetic force needed to position the adjustable guide vanes such that the airflow exit speed at each of the one or more airflow exit points is consistent within a predetermined range further comprises computer program instructions that when executed by a computer cause the computer to carry out the steps of determining an amount of friction that exists at each of the one or more pivot points.

18. The computer program product of claim 15 wherein computer program instructions that when executed by a computer cause the computer to carry out the steps of determining the amount of magnetic force needed to position the adjustable guide vanes such that the airflow exit speed at each of the one or more airflow exit points is consistent within a predetermined range further comprises computer program instructions that when executed by a computer cause the computer to carry out the steps of determining a position of the pivot point for each of the adjustable guide vanes.

19. The computer program product of claim 15 wherein computer program instructions that when executed by a computer cause the computer to carry out the steps of determining the amount of magnetic force needed to position the adjustable guide vanes such that the airflow exit speed at each of the one or more airflow exit points is consistent within a predetermined range further comprises computer program instructions that when executed by a computer cause the computer to carry out the steps of determining a position of a vane magnet included in each of the adjustable guide vanes.

20. The computer program product of claim 15 wherein computer program instructions that when executed by a computer cause the computer to carry out the steps of determining the amount of magnetic force needed to position the adjustable guide vanes such that the airflow exit speed at each of the one or more airflow exit points is consistent within a predetermined range further comprises computer program instructions that when executed by a computer cause the computer to carry out the steps of determining a position of one or more impeller magnets included in the impeller.

21. The computer program product of claim 15 wherein computer program instructions that when executed by a computer cause the computer to carry out the steps of determining the amount of magnetic force needed to position the adjustable guide vanes such that the airflow exit speed at each of the one or more airflow exit points is consistent within a predetermined range further comprises computer program instructions that when executed by a computer cause the computer to carry out the steps of determining a distance between one or more vane magnets included in the adjustable guide vanes and one or more impeller magnets included in the impeller.

22. A method of improving airflow from a blower with adjustable guide vanes that are affixed to the blower at one or more pivot points located in an outlet of the blower, wherein an impeller in the blower includes one or more magnetic elements and wherein each adjustable guide vane includes one or more magnetic elements, the method comprising:

determining a rotational speed of the impeller;

adjusting, in dependence upon the rotational speed of the impeller, a magnetic force between the one or more magnetic elements in the impeller and at least one magnetic element in a particular adjustable guide vane such that the airflow exit speed at each of one or more airflow exit points is consistent within a predetermined range.

23. The method of claim 22 wherein the one or more magnetic elements in the impeller are encased within a closeable cell and wherein adjusting, in dependence upon the rotational speed of the impeller, the magnetic force between the one or more magnetic elements in the impeller and at least one magnetic element in the particular adjustable guide vane further comprises adjusting the closeable cell.

24. The method of claim 22 wherein at least one magnetic element in a particular adjustable guide vane is encased within a closeable cell and wherein adjusting, in dependence upon the rotational speed of the impeller, the magnetic force between the one or more magnetic elements in the impeller and at least one magnetic element in the particular adjustable guide vane further comprises adjusting the closeable cell.

25. The method of claim 22 wherein the one or more magnetic elements in the impeller are electromagnets and wherein adjusting, in dependence upon the rotational speed of the impeller, the magnetic force between the one or more magnetic elements in the impeller and at least one magnetic element in the particular adjustable guide vane further comprises adjusting a current applied to the electromagnet.

* * * * *